US006097356A

United States Patent [19]

Fan

[11] Patent Number: 6,097,356

[45] Date of Patent: Aug. 1, 2000

[54] METHODS OF IMPROVING DISPLAY UNIFORMITY OF THIN CRT DISPLAYS BY CALIBRATING INDIVIDUAL CATHODE

[76] Inventor: Nongqiang Fan, 3855 Woodhollow, Apt. 216, Euless, Tex. 76040

[21] Appl. No.: 09/107,969

[22] Filed: Jun. 30, 1998

Related U.S. Application Data

[60] Provisional application No. 60/051,488, Jul. 1, 1997.

[51] Int. Cl.[7] ..... G09G 3/22

[52] U.S. Cl. ..... 345/60; 345/75; 345/74

[58] Field of Search ..... 345/74, 75, 76, 345/77, 78, 147, 82, 60; 315/169.1, 169.2, 169.3

[56] References Cited

U.S. PATENT DOCUMENTS

| | | | |
|---|---|---|---|
| 5,157,309 | 10/1992 | Parker | 315/169.1 |
| 5,262,698 | 11/1993 | Dunham | 315/169.1 |
| 5,514,937 | 5/1996 | Kane | 315/169.1 |
| 5,578,906 | 11/1996 | Smith | 315/169.3 |
| 5,581,159 | 12/1996 | Lee | 315/167 |
| 5,610,471 | 3/1997 | Bandy | 313/309 |
| 5,627,436 | 5/1997 | Suzuki | 315/169.1 |
| 5,637,023 | 6/1997 | Itoh | 445/24 |
| 5,708,451 | 1/1998 | Baldi | 345/75 |

FOREIGN PATENT DOCUMENTS

| | | | |
|---|---|---|---|
| 0 661 726 A1 | of 1995 | European Pat. Off. | H01J 31/12 |
| 0 686 993 A1 | of 1995 | European Pat. Off. | H01J 31/12 |
| 0 755 042 A1 | of 1997 | European Pat. Off. | G09G 3/22 |
| 0 803 892 A2 | of 1997 | European Pat. Off. | H01J 29/08 |

*Primary Examiner*—Xiao Wu

[57] ABSTRACT

Methods of improving the display uniformity of a thin CRT display are disclosed. These methods can provide nearly perfect display uniformity for a thin CRT display despite the fact that the emission characteristics of those cathodes in the thin CRT display are intrinsically non-uniform due to the inevitable manufacture variations. In order to improve the display uniformity of a thin CRT display, the emission characteristics of all cathodes are measured, and calibration parameters for each cathode are obtained from the measured emission characteristics of the corresponding cathode. The calibration parameters of each cathode are stored in a calibration memory (70) as a complete look-up table or a partial look-up table. With a complete look-up table, when the CPU want to display a pixel with a desired luminosity, it will use the complete look-up table of the corresponding cathode to find the correct driving parameters. With a partial look-up table, when the CPU want to display a pixel with a desired luminosity, it will use the partial look-up table of the corresponding cathode in combination with additional calculation to find the correct driving parameters, and these calculations can be performed with the main CUP or a dedicated display processor (60).

17 Claims, 21 Drawing Sheets

METHODS OF IMPROVING DISPLAY UNIFORMITY OF THIN CRT DISPLAYS BY CALIBRATING INDIVIDUAL CATHODE

This invention is related to thin CRT displays, and specially to a method for improving the display uniformity of thin CRT displays. This Appln claims the benefit of U.S. Provisional No. 60/051,488, filed Jul. 1, 1997.

BACKGROUND OF THE INVENTION

A thin CRT display is a type of flat panel display which uses a matrix of cold cathodes to emit electrons towards an anode faceplate coated with phosphors. The most promising type of thin CRT displays use Spindt field emission cathodes, and they are often called Field Emission Displays (FED). Another promising type of thin CRT displays use Surface Conducting Electron (SCE) cathodes developed by Canon. And other kinds of cold cathode which can be used to construct thin CRT displays include MIS cathodes developed by Pioneer Electric Corp. (which is also called High Efficiency Electron-Emission Device, or Heed) , Silicon avalanche cathodes developed by Philip, diamond cathodes developed by SI Diamond, MIM cathodes, pn junction cathodes and Schoftky junction cathodes.

Thin CRT displays have the potential to provide image qualities comparable to conventional CRT displays. But, because the light intensity of each pixel is determined by the electron emission characteristics of one or more cold cathodes behind the phosphors segment of that pixel, it is difficult to make thin CRT displays with uniform display intensity. The variations of the display intensity is due to the variations of the electron emission characteristics of all the cathodes. The variations of the electron emission characteristics are inevitable, because large numbers of cathodes have to be manufactured over a very large area. It is important to improve the display uniformity, if one want to make thin CRT displays with large number of gray levels, such as 256 levels for each color.

There have been many attempts to improve the display uniformity of thin CRT displays. Some of the methods, such as those described by U.S. Pat. No. 5,637,023 and No. 5,610,471 and the references cited therein, try to use better manufacture techniques to improve uniformity of all cold cathodes. And some of the methods, such as those described by U.S. Pat. No. 5,157,309 and No. 5,581,159, try to use better driver electronic designs to improve the electron emission uniformity of all the cathodes. And there is still some other methods, such as U.S. Pat. No. 5,514,937, which use memory element associated with each electronic driver to compensate the variations among different cathodes. All these methods only provide limited success, and some of these methods are complicated and expansive to implement.

In this document, the applicant present a new method, which the applicant claims to solve the uniformity problem of thin CRT displays once for all. The new method provides almost perfectly uniform display properties for thin CRT displays regardless the inevitable variations of each cathode. The new method disclosed in this document is performed in three steps: First, the emission characteristics of every cathode in the display is measured. Second, the correct driving parameters for each cathode—used as calibration parameters directly—are calculated and stored in a calibration memory as a complete look-up table, or the calibration parameters for each cathode are calculated and stored in a calibration memory as a partial look-up table. Third, using the complete look-up tables or using partial look-up tables in combination with additional calculation, the correct driving parameter for any cathode with any luminosity level can be obtained, and the correct driving parameters are used to drive the thin CRT display. For the first step described above, the emission characteristics of all cathodes can be measured by a current detector connected to the anode, or can be measured in a dark chamber by turning on one cathode at a time. For the second step described above, linear approximation or other higher order approximation can be used. For the third step, there are two general embodiments: (1) with embodiment one, all the calculated correct driving parameters are stored in a video memory and driver electronics use these calculated correct driving parameters in the video memory to drive the display; (2) with embodiment two, the desired light intensities are stored in a video memory without any compensation, and using the complete look-up tables or using partial look-up tables in combination with additional calculation, the driver electronics calculate the correct driving parameters by fetching the light intensities from the video memory and use these calculated correct driving parameters to drive the display directly. For both embodiments mentioned above, when partial look-up tables are used, additional calculations are needed to obtain the correct driving parameters, and these calculations can be performed by the main microprocessor or a dedicated display processor.

SUMMARY OF THE INVENTION

It is an object of the invention to provide a method that can provide almost perfectly uniform display properties for thin CRT displays regardless the inevitable variations of each cathode.

Additional advantages and novel features of the invention will be set forth in the description which follows, and in part will become apparent to those skilled in the art upon examination of the following, or may be learned by practice of the invention. The objects and advantages of the invention maybe realized and attained by means of the instrumentality and combinations particularly pointed out in the appended claims.

To achieve the foregoing and other objects and in accordance with the present invention, as described and broadly claimed herein, a measurement method is provided to measure the emission characteristics of every cathode in the display, a calculation method is provided to obtain the calibration parameters of any given cathode by using the measured emission characteristics of the corresponding cathode as the raw data, a calibration memory is provided to store the calibration parameters for any given cathode as a complete look-up table or as a partial look-up table, a method is provided to obtain the correct driving parameters for any given cathode for any give light intensity by using the complete look-up table without additional calculation or by using the partial look-up table with additional calculation, and finally a driver electronics is provided to drive the display with the correct driving parameters. For the measurement method provided to measure the emission characteristics of every cathode in the display, either a current detector connected to the anode or a dark chamber can be used. A thin CRT display driven by the correct driving parameters will provide images free of intensity distortions caused by each cathode's property variations.

BRIEF DESCRIPTION OF THE DRAWINGS

The accompany drawings, which are incorporated in and form a part of the invention and, together with the description, serve to explain the principles of the invention. In the drawings, closely related figures have the same number but different alphabetic suffixes.

FIG. 8*c* shows that the luminosity perceived by an user is linearly proportional to the time period that the cathode is turned on.

FIG. 9*c* shows that the luminosity perceived by an user is linearly proportional to the time period that the cathode is turned on.

DESCRIPTION OF THE INVENTION

Even though the techniques disclosed in present invention can be used to improve the display uniformity of any kind of thin CRT displays with any kind of cold cathodes and with any kinds of driving schemes, but, to simplify the presentation, we first use Spindt Field Emission Display (FED) as an example to demonstrate how present invention is used to improve the display uniformity of this most common type of thin CRT displays. Then, we will extend the technique to other kinds of thin CRT displays using other kinds of cold cathodes, such as SCE cathodes, MIS cathodes and diamond cathodes.

FED technology have been disclosed in many patent documents, and the basic patents describing the technology include U.S. Pat. Nos. 3,500,102, 4,857,799 and 4,763,187, which are included hereinafter by reference. The basic principle of a FED is quite similar to that of a CRT display—with the modification that the single electron gun for each color in CRT displays is replaced by a matrix of individually addressable filed emission cold cathodes, with one cathode for each pixel.

Figure 1A:
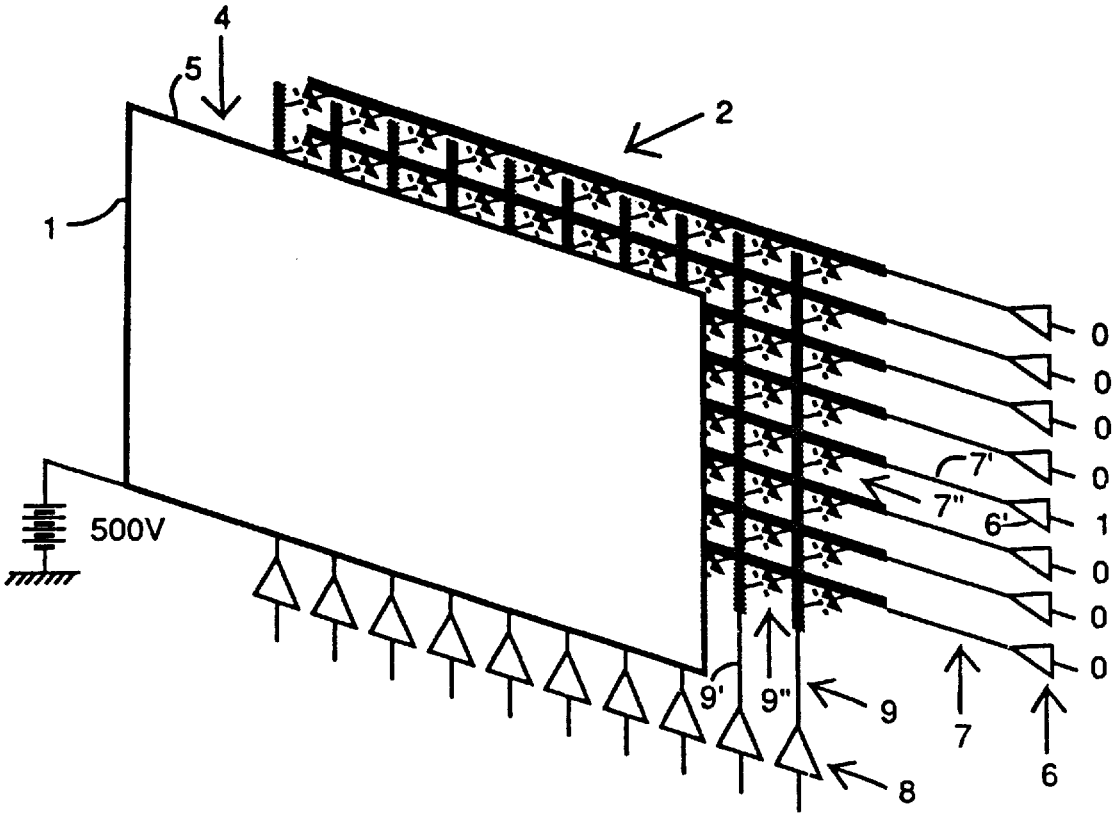
Fig. 1a (PRIOR ART)
FIG. 1*a* shows the principle of an FED display.
Figure 1B:
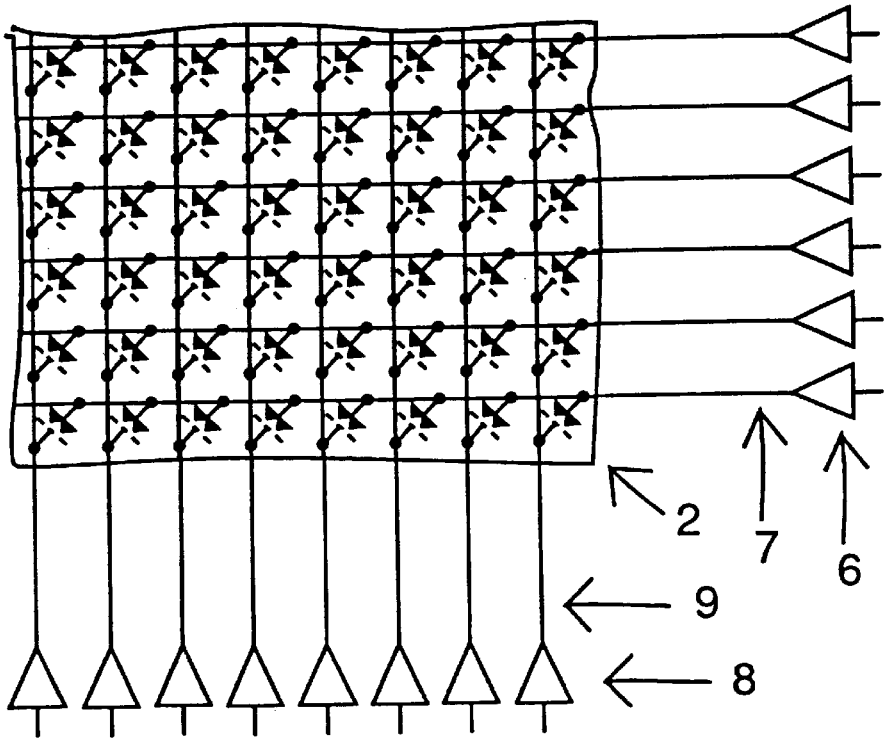
Fig. 1b (PRIOR ART)
FIG. 1*b* shows a section of the matrix of field emission cold cathodes.

As illustrated in FIG. 1*a* and 1*b*, a FED includes a transparent anode plate 1, a matrix of individually addressable filed emission cold cathodes 2 fixed on a back plate 3

Figure 1C:
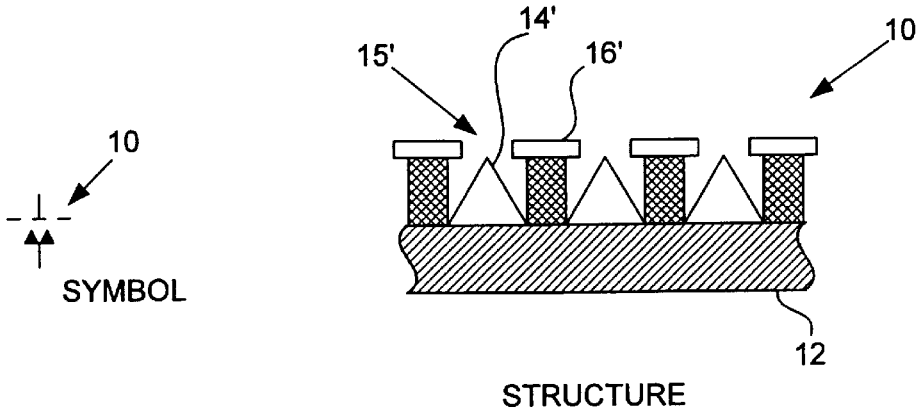
Fig. 1c (PRIOR ART)
FIG. 1*c* shows the enlarged symbol and the structure of a field emission cold cathode.

(not shown in FIG. 1*a* and 1 *b*), and a vacuums space 4 between the anode and the cathode matrix 2. Each of the filed emission cold cathodes is represented by a special symbol, and one of the filed emission cathode 10 with an enlarged symbol is illustrated in FIG. 1*c* The side of the anode plate 1 facing the cathode matrix are coated phosphors 5, and the anode plate 1 is kept at a potential typically around 500 volts relative to the common ground. A driver array 6 is connected to a set of driving lines 7, and each driving line 7' is connected to one end of a cathode array 7" in the cathode matrix 2. A second driver array 8 is connected to a second set of driving lines 9, and each driving line 9' is connected to the other end of a cathode array 9" in the cathode matrix 2. One row (or column) of cathodes 7" is turned on at one time by turning on one driver 6' in the driver array 6, and the number of electrons emitted from each of cathodes in that row (or column) is controlled by the different voltages applied to the different drivers in the second driver array 8. Each row (or column) of cathode is turned on one by one by scanning the on-state driver 6' in the driver array 6. The electrons emitted from the cathodes are accelerated towards the anode, and impact the phosphors 5 on the anode plate 1; the phosphors 5 excited by the impact electrons will emit light with the light S intensity determined by the number of electrons emitted from the corresponding filed emission cathodes.

To understand in detail how the number of electrons emitted from each cathodes is controlled, it is necessary to understand the principle of a filed emission cold cathode. As shown in FIG. 1*c*, a filed emission cold cathode 10 has a base electrode 12. A matrix of metal or semiconductor sharp tips 14 are constructed on top of the base electrode 12. Each tip 14' in the tip matrix 14 is covered with a gate 16'. All the individual gate 16' connected together form the second electrode 16 of the cold cathode. As shown in FIG. 1*c*, the gate 16' covers the tip 14' with a hole 15' lined up with the tip 14' in the middle. The size of the tip 14' is usually on the order of sub-microns, and the vertical distance between the tip 14' and the gate 16' is usually on the order of microns. When a positive voltage on the order of tens of volts is applied to the gate electrode, the electrons in the tip will be extracted out by filed emission. The emitted electrons shoot out into the vacuum though the center hole 15' on the gate 16'. The number of electrons emitted into the vacuum is the function of the voltage difference applied between the base electrode and the gate electrode. When the cathodes in the cathode array 7" is selected for emission, the on-state driver 6' will set the bias voltage, on each of the cathodes in that cathode array 7", close to the threshold voltage $V_{th}$. The amount of electrons emitted from each individual cathode in the cathode array 7" is determined by the voltage on the corresponding driving lines driven by the second array of drivers 8. By controlling the amount of electrons emitted from each individual cathode in the cathode array 7", a line of image is displayed on the anode plate, and by scanning quickly the on-state driver 6' one by one, a complete image is displayed on the anode plate.

It is noted that in the above described filed emission display, the on-state driver can either connected to the base electrode of the cathodes or the gate electrode of the cathodes, and correspondingly, the second driver arrays can be connected either to the gate electrode of the cathodes or the base electrode of the cathodes.

One of the biggest problem with the previously described voltage driven FED is that it is very difficult to achieve the necessary display uniformity with present Spindt cold cathodes technology. Different cathode driven methods have been invented to circumvent the non-uniformity problem. Some of these cathode driven methods, such as current-driving method described in U.S. Pat. No. 5,157,309, provide substantial improvement in display uniformity. But, the current-driving method still have display non-uniformity problem, and more methods are conceived to solve the non-uniformity problem of current-driving method, such as the methods described in U.S. No. 5,578,906 and 5,514,937. However, with the methods to be disclosed in the following, nearly perfect display uniformity can be achieved for any kinds of driving schemes. To illustrate the effectiveness of present invention, in the following, we will first demonstrate that even the inferior voltage-driving method can achieve perfect display uniformity by using present disclosed invention. The embodiment of using present invention with current-driving and other superior cathode driven methods will be disclosed following the discussion on the voltage-driving method.

Figure 2A:
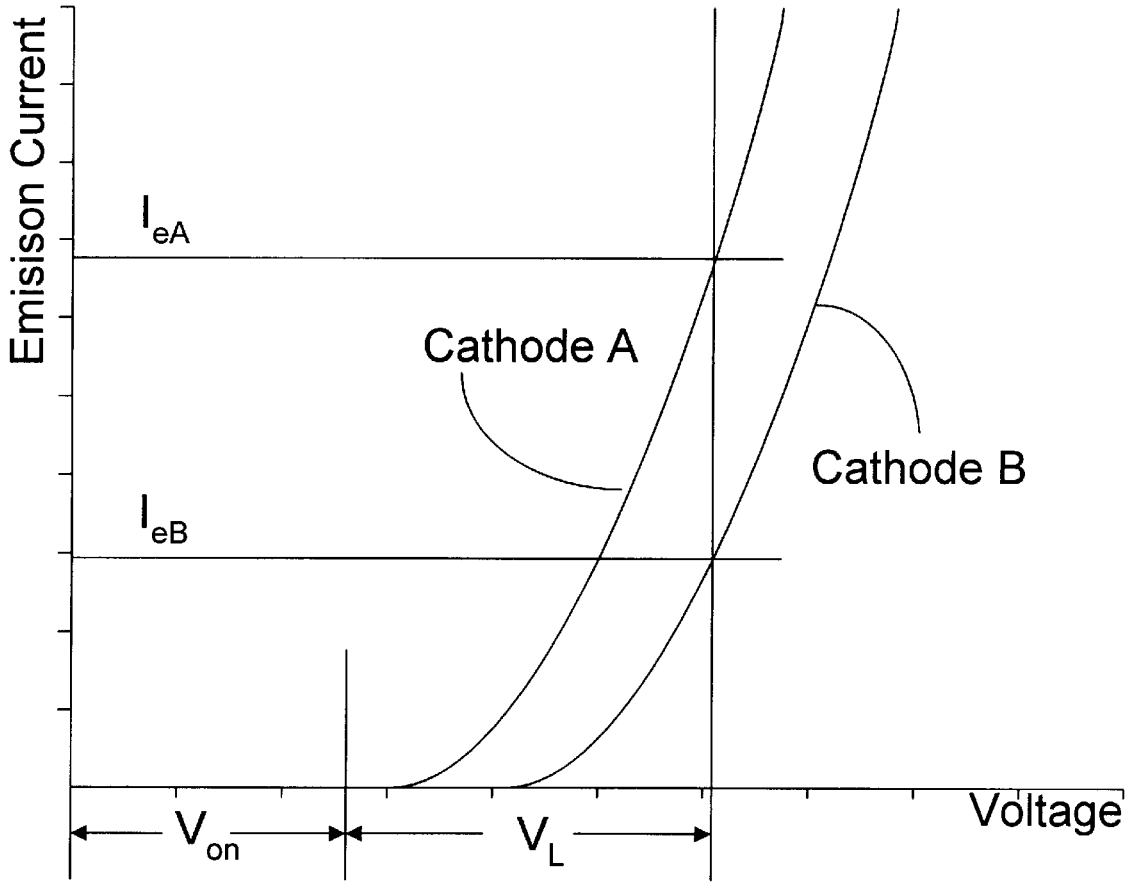
FIG. 2*a* shows that, with the same bias voltage, two different cold cathodes give completely different emission current and therefore completely different pixel luminosity.
Figure 2B:
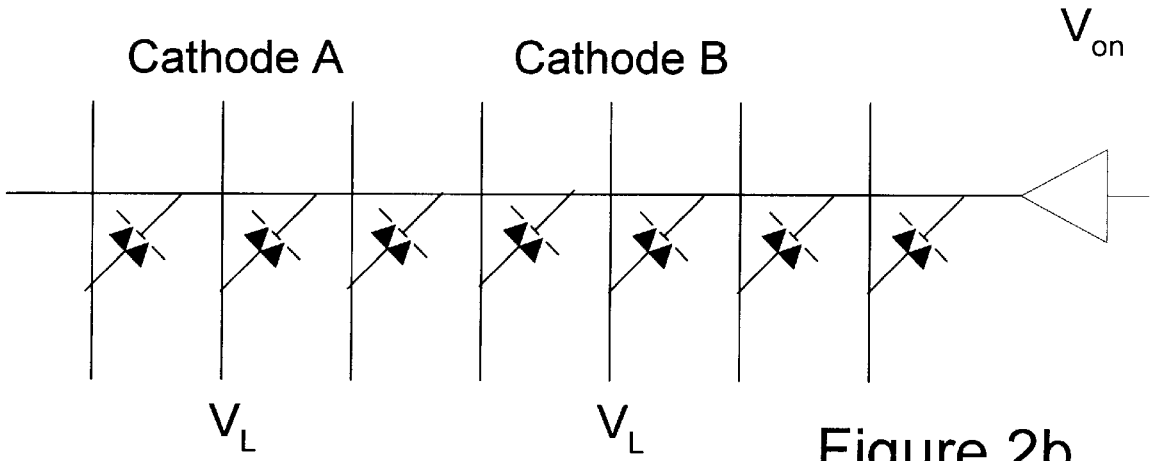
FIG. 2*b* shows that the same bias voltage is applied to two different cold cathodes in the same selected row.

The display uniformity problem is due to the variations of emission characteristics of all the cathodes in the cathode matrix. Such variations are inevitable, because very large number of cold cathodes are manufactured. FIG. 2*a* shows that, with the same bias voltage, two different cold cathodes give completely different emission current and therefore completely different pixel luminosity, where, $V_{on}$ is the voltage applied by the on-state driver to select a particular row into emission mode, and $V_L$ is the same luminosity voltage applied to cathode A and cathode B as indicated in FIG. 2*b*. As shown in FIG. 2*a*, even though the total voltage applied to the two cathodes (A and B) is the same $V_{on}+V_L$, the emission current from the two cathodes are different (they are $I_{eA}$ and $I_{eB}$ respectively for cathode A and B), because the emission characteristics (or the curve defined by emission current $I_e$ versus driving-voltage V) of the two cathodes are different. These difference in emission current can be compensated, however, if one knows the emission characteristics of the corresponding cold cathodes.

The very basic idea of present invention can be summarized by operating thin CRT displays in three steps. First, the emission characteristics of every cathode in the display is measured. Second, the correct driving voltages for each cathode used as calibration parameters directly are calculated and stored in a calibration memory as a complete look-up table—which is called method one, or the calibration parameters for each cathode are determined and stored in a calibration memory as a partial look-up table—which is called method two. Third, when a certain luminosity in a certain pixel is to be displayed, the microprocessor will use the a complete look-up table in the calibration memory to find the correct driving voltage for that luminosity, or, the microprocessor will use the partial look-up table in the calibration memory in combination with additional calculation to find the correct driving voltage for that luminosity, and the correct driving voltage is used by the driver electronics to drive the display.

Figure 3:
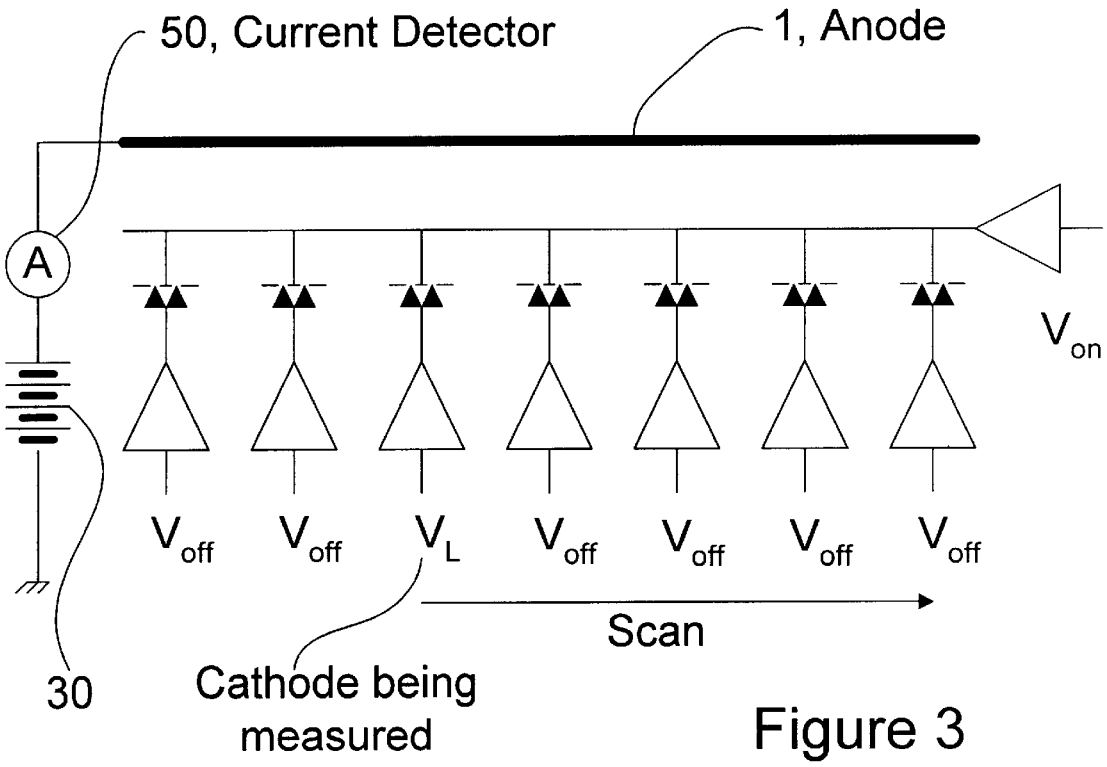
FIG. 3 illustrates that the emission characteristics of every cold cathode in a selected row is measured one by one in a scan mode, by measuring the emission current of each cold cathode with a current detector.
Figure 4A:
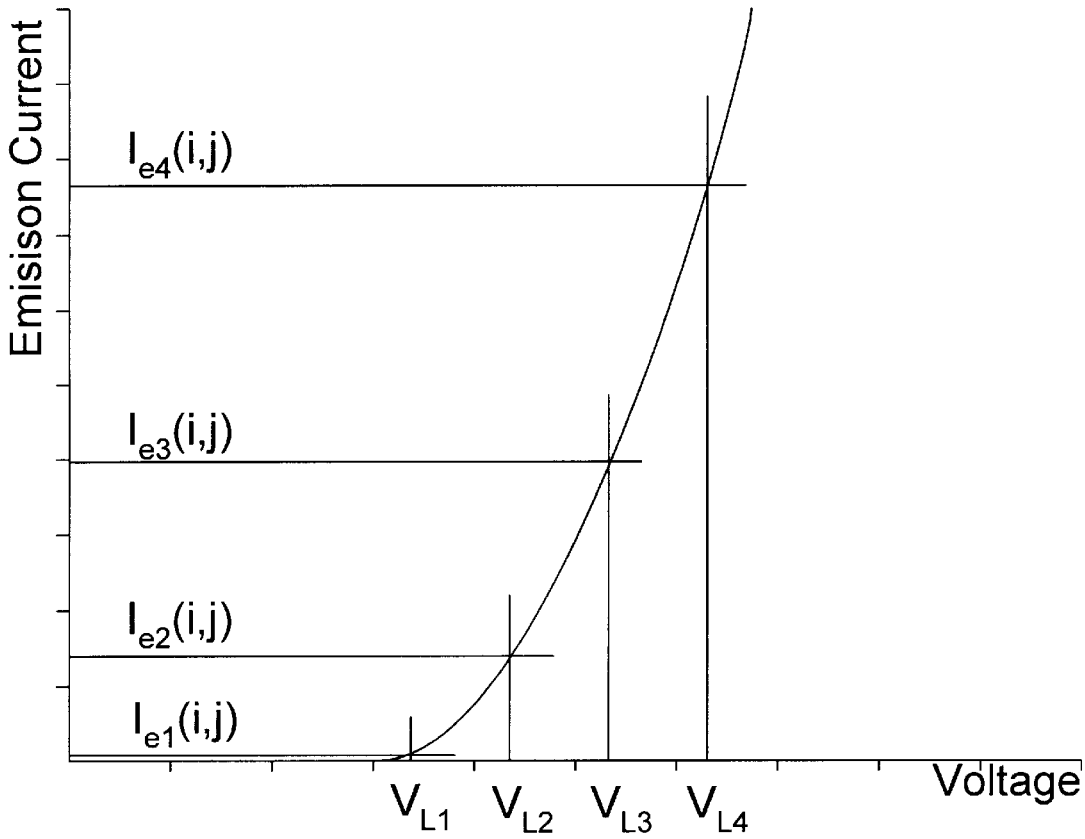
FIG. 4*a* shows that the emission characteristics of a cold cathode is measured by measuring the emission current of the cold cathode under several selected bias voltages.

FIG. 3 shows how the emission characteristics of all cathodes are measured by a current detector 50 connected between the anode 1 and the anode voltage 30. Like in the conventional display mode, the gate electrodes (or alternatively the emitter electrodes) of only one row is biased to the on-voltage $V_{on}$. All the rows are scanned one by one. But, in contrast to the display mode where luminosity voltage $V_L$ of all cathodes in that turned-on row are applied simultaneously, in the calibration mode, only one cathode is applied with luminosity voltage $V_L$ and the rest of the cathodes in that row are turned off, which is shown in FIG. 3. By measuring the emission current corresponding to several different values of luminosity voltage, the emission characteristics of that one cathode is measured and stored in a memory for further processing. The number of points on the emission characteristics need to be measured depend on the non-linearity of the emission curve and the required display resolution ( e.g. 4 bit or 8 bit). If the emission curve is close to linear, which is the case for some of the cathode driving methods to be discussed later (e.g. current-driving method), only one measurement is necessary for each cathode. As shown in FIG. 3, the emission characteristics of all the cathodes in that selected row can be measured one at a time by scanning all the cathodes in that row. After all the cathodes in that row are measured, that row will be turned off and next row will be turned on, and the all the cathodes in the newly selected row will be measured one by one. By scanning all the rows in the matrix, the emission characteristics of all the cathodes in the matrix can be measured. As shown in FIG. 4*a*, the emission characteristics of a cathode at row i and column j, is characterized by a set of numbers, $I_{e1}(i, j)$ for luminosity voltage $V_{L1}$, $I_{e2}(i, j)$ for luminosity voltage $V_{L2}$, $I_{e3}(i, j)$ for luminosity voltage $V_{L3}$, . . . , and $I_{eH}(i, j)$ for luminosity voltage $V_{LH}$, where H is the number of points on the emission curve measured for each cathode. These numbers are stored in a memory for further processing. If the number of row is N and the number of column is M, then a total of N*M*H numbers are stored in the memory.

If there is no cathode degrading effect, the above calibration process need to be performed only once. If there are cathode degrading effect, above calibration process need to be performed again at a later time to correct the cathode degrading effect.

Figure 4B:
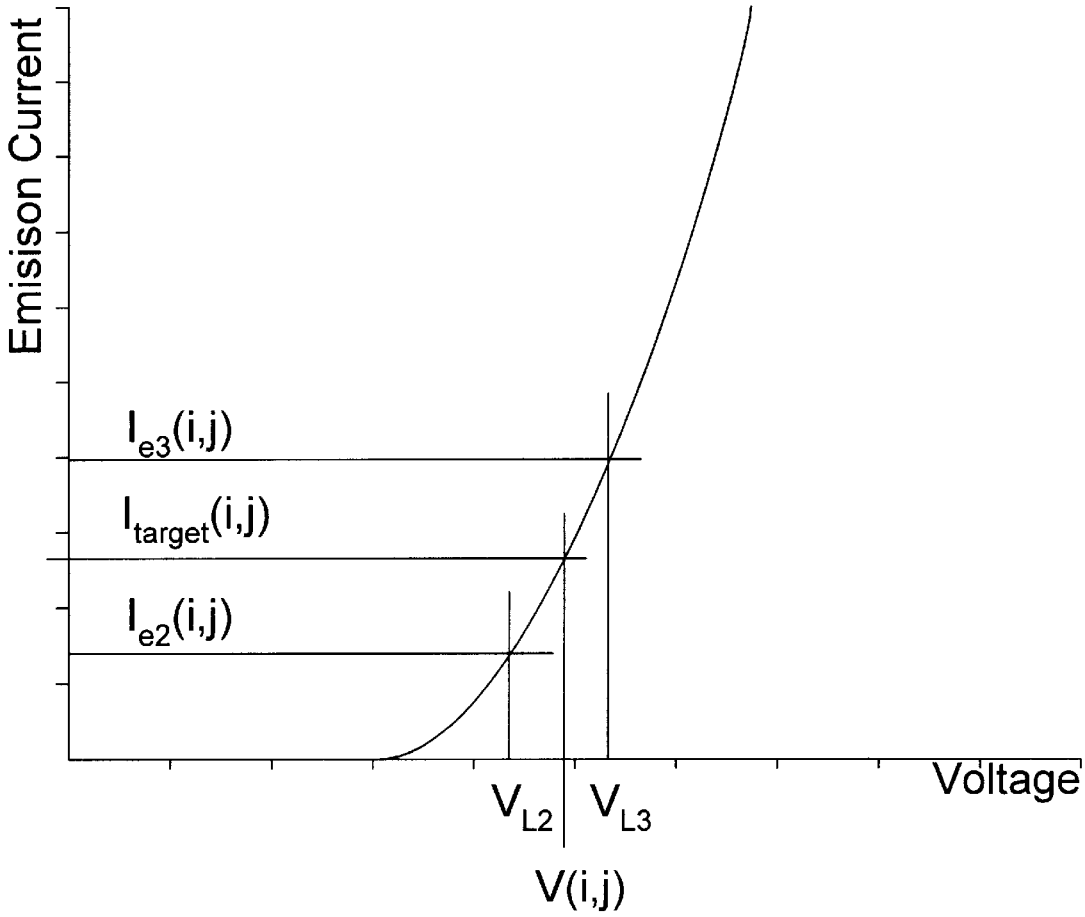
FIG. 4*b* shows one can use linear approximation and measured data points to calculate the correct voltage V(i, j) which will provide the desired emission current $I_{target}(i, j)$.

After the measurement of the emission curves of all cathodes, the correct driving voltage for any desired emission current for any cathodes can be calculated. For example, for cathode (i,j) at i'th row and j'th column, to calculate a desired emission current $I_{target}(i, j)$, one first compare the desired emission current $I_{target}(i, j)$ with all the measured emission current $I_{e1}(i, j)$ $I_{e2}(i, j)$, $I_{e3}(i, j)$ and $I_{eH}(i, j)$. Suppose that $I_{target}(i, j)$ happen to be between $I_{e2}(i, j)$ and $I_{e3}(i, j)$ as shown in FIG. 4*b*, then, one can simply use linear approximation to calculate the correct driving voltage V (i, j), which is given by $$V(i, j) = \frac{V_{L3}[I_{target}(i, j) - I_{e2}(i, j)] + V_{L2}[I_{e3}(i, j) - I_{target}(i, j)]}{I_{e3}(i, j) - I_{e2}(i, j)}.$$

Or, to increase the accuracy in calculating V (i, j), one can use parabola approximation or other higher order approximations. For polynomial approximation with order H, the correct driving voltage V (i, j) is given by $$V(i, j) = \frac{[I_{e2}(i, j) - I_{target}(i, j)][I_{e3}(i, j) - I_{targe}(i, j)] \cdots [I_{eH}(i, j) - I_{target}(i, j)]}{[I_{e2}(i, j) - I_{e1}(i, j)][I_{e3}(i, j) - I_{e1}(i, j)] \cdots [I_{eH}(i, j) - I_{e1}(i, j)]} V_{L1}(i, j) + \frac{[I_{e1}(i, j) - I_{target}(i, j)][I_{e3}(i, j) - I_{targe}(i, j)] \cdots [I_{eH}(i, j) - I_{target}(i, j)]}{[I_{e1}(i, j) - I_{e2}(i, j)][I_{e3}(i, j) - I_{e2}(i, j)] \cdots [I_{eH}(i, j) - I_{e2}(i, j)]} V_{L2}(i, j) + \cdots$$

One can even use more complicated algorithm, such as, use least square fit in combination with device models to calculate the correct driving voltage V(i, j) which can achieve the desired intensity $I_{target}(i, j)$ . For example, one can use Fowler-Nordheim model, $I=aV^2 \exp(-b/V)$, and first use least square fit to determine the model paramaters a and b by fitting the model curve with all measured data on the emission curve, then, one can calculate the correct driving voltage V(i, j) which can achieve the desired intensity $I_{target}(i, j)$ by finding the voltage V(i, j) for equation $I_{target}(i, j)-a(i, j)V^2(i, j)e^{-b(i,j)/V(i,j)}=0$ where a(i,j) and b(i,j) are calibration parameters which are already known from curve fitting.

There are generally two methods of using the measured emission curve to provide a perfectly uniform display. With method one, for every cathode in the display, the correct driving voltages for all gray levels are calculated; these correct driving voltages are used as calibration parameters directly and stored as complete look-up tables in a calibration memory for future use; and one will use the complete look-up table to find the correct driving voltages without the need to perform additional calculation. With method two, for every cathode in the display, calibration parameters are calculated and stored as partial look-up tables in a calibration memory for future use; and one will use the partial look-up table in combination with some additional calculation in real time to find the correct driving voltages. As for the calibration parameters, the correct driving voltages for selected number of gray levels can be calculated and used as the calibration parameters, or other model-dependent parameters can be calculated and used as the calibration parameters.

If there is no cathode degrading effect, the above described look-up tables need to be calculated only once, and these look-up tables can be stored in a permanent memory, such as ROM, or hard disk. If there are cathode degrading effect, the above described look-up tables need to calculated again at a later time to correct the cathode degrading effect. If the look-up tables are stored in a relatively fast ROM, the ROM can be used directly as the calibration memory. If the look-up tables are stored in a slower permanent memory, say, hard disk, the look-up tables will have to be loaded into a faster RAM from the permanent memory, and use this RAM as the calibration memory.

Figure 5A:
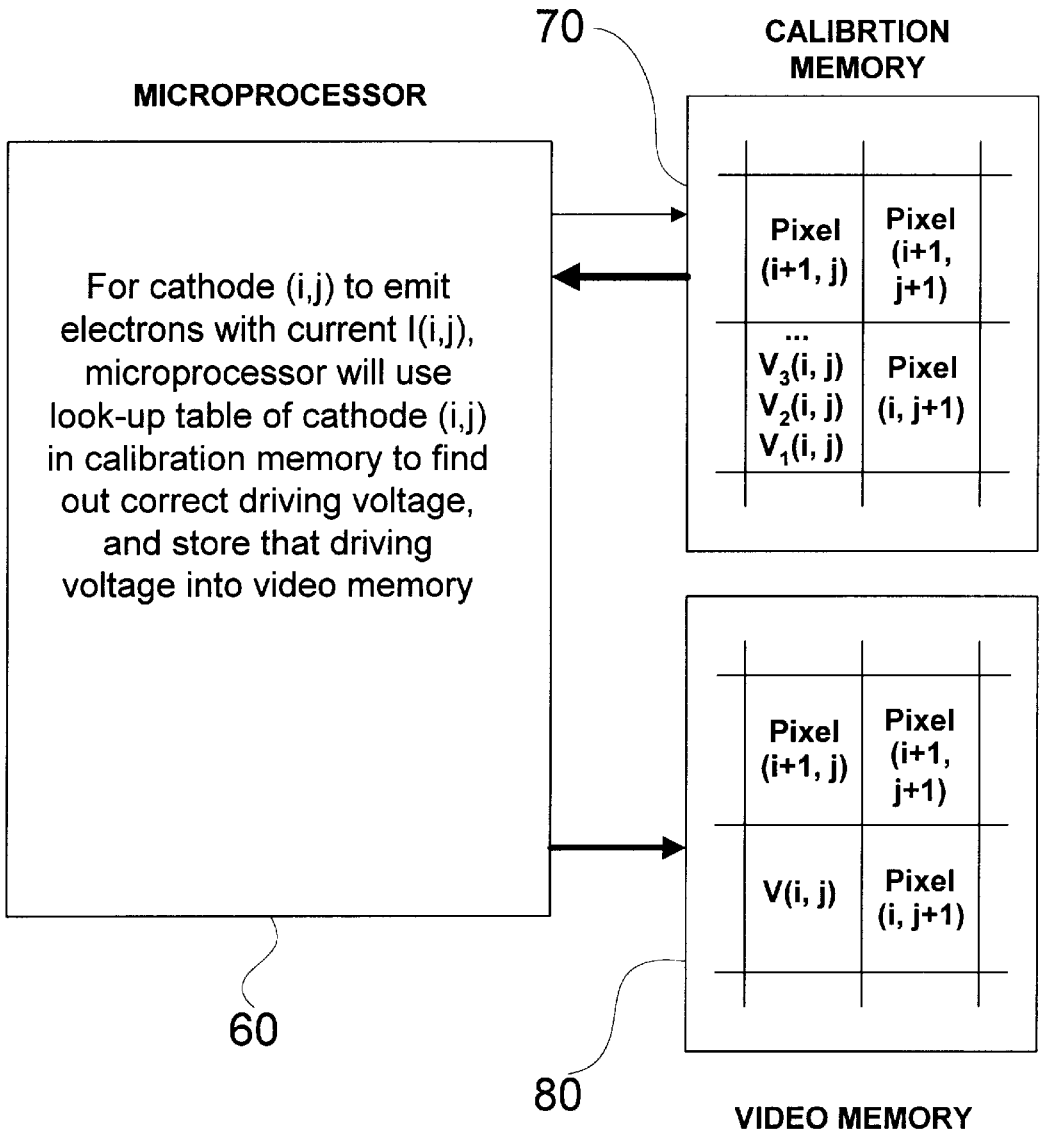
FIG. 5*a* shows that a microprocessor use the look-up table in the calibration memory to find out the correct driving voltage, and store the correct driving voltage into the video memory.
Figure 5B:
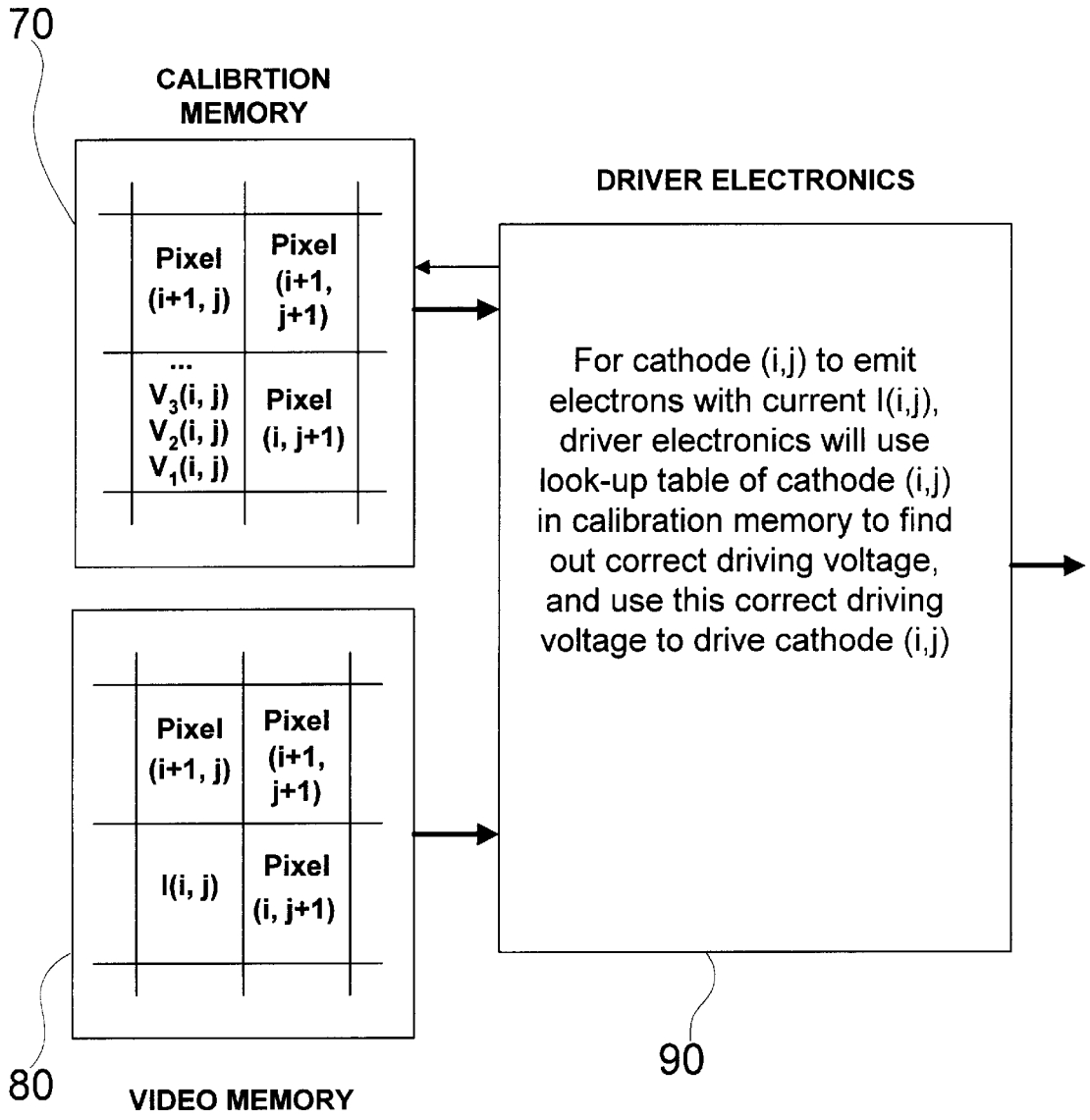
FIG. 5*b* shows that the driver electronics fetch uncompensated light intensity from the video memory and use the look-up table in calibration memory to find out the correct driving voltage.

FIG. 5*a* shows in detail the method one mentioned above. With method one, for every cathode in the display, the correct driving voltages—$V_1(i, j)$, $V_2(i, j)$ $V_3(i, j)$, and $V_K(i, j)$—for all gray levels with corresponding desired emission current—$I_1$, $I_2$, $I_3$ . . . , and $I_K$—are calculated by using linear approximation or other previously described methods. More specifically, for 8 gray levels, 8 voltages are calculated for each cathode, and for 256 gray levels, 256 voltages are calculated. These calculated correct driving voltages are used as calibration parameters directly and stored in a calibration memory 70. With a conventional display, if a computer want a pixel to display certain intensity, it will write the intensity word (which is a byte for 8 bit gray level) of the pixel to a location in the video memory 80, and the driver electronics will use the intensity words in video memory 80 to drive the display. With present newly invented display, however, if a computer want a pixel to display certain desired intensity, it will first use the look-up table of the cathode associated with the corresponding pixel in calibration memory 70 to find out the correct driving voltage for that desired intensity, write this correct driving voltage to video memory 80, and the driver electronics will use the correct driving voltages in video memory 80 to drive the field emission display. Alternatively, as shown in FIG. 5*b*, the computer can still write the uncompensated intensity word to video memory 80, but, the driver electronics itself will use the look-up tables in calibration memory 70 to find out the correct driving voltage for any gray level of any cathode, and use this correct driving voltage to drive the field emission display.

Above described method one is relatively easy to implement, but, if a display has large number of cathodes and each cathode has large number of gray levels, the amount of calibration memory required can be quite large. For example, for a 256-gray-level display with one million pixels, one need to store 256 million numbers. If each correct driving voltage is stored as a byte to represent the absolute number, then, 256 Megabyte calibration memory is needed. To reduce the memory requirement, one can instead store relative numbers in calibration memory 70. For example, one can sore relative number $\Delta V_k(i, j)=V_k(i, j)-\overline{V}_k$ into calibration memory 70, where $\overline{V}_k=\Sigma V_k(i, j)$ is the average driving voltage for gray level k averaged over all cathodes, and $1 \leqq k \leqq K$. If the variations among different cathodes are small, one can use a smaller number of bit (such as 4 bit) to represent $\Delta V_k(i, j)$ even one need 8 bit to represent $V_k(i, j)$. Another way to reduce the calibration memory requirement, which is the method two mentioned previously, is to use partial look-up tables, instead of complete look-up tables.

Figure 6A:
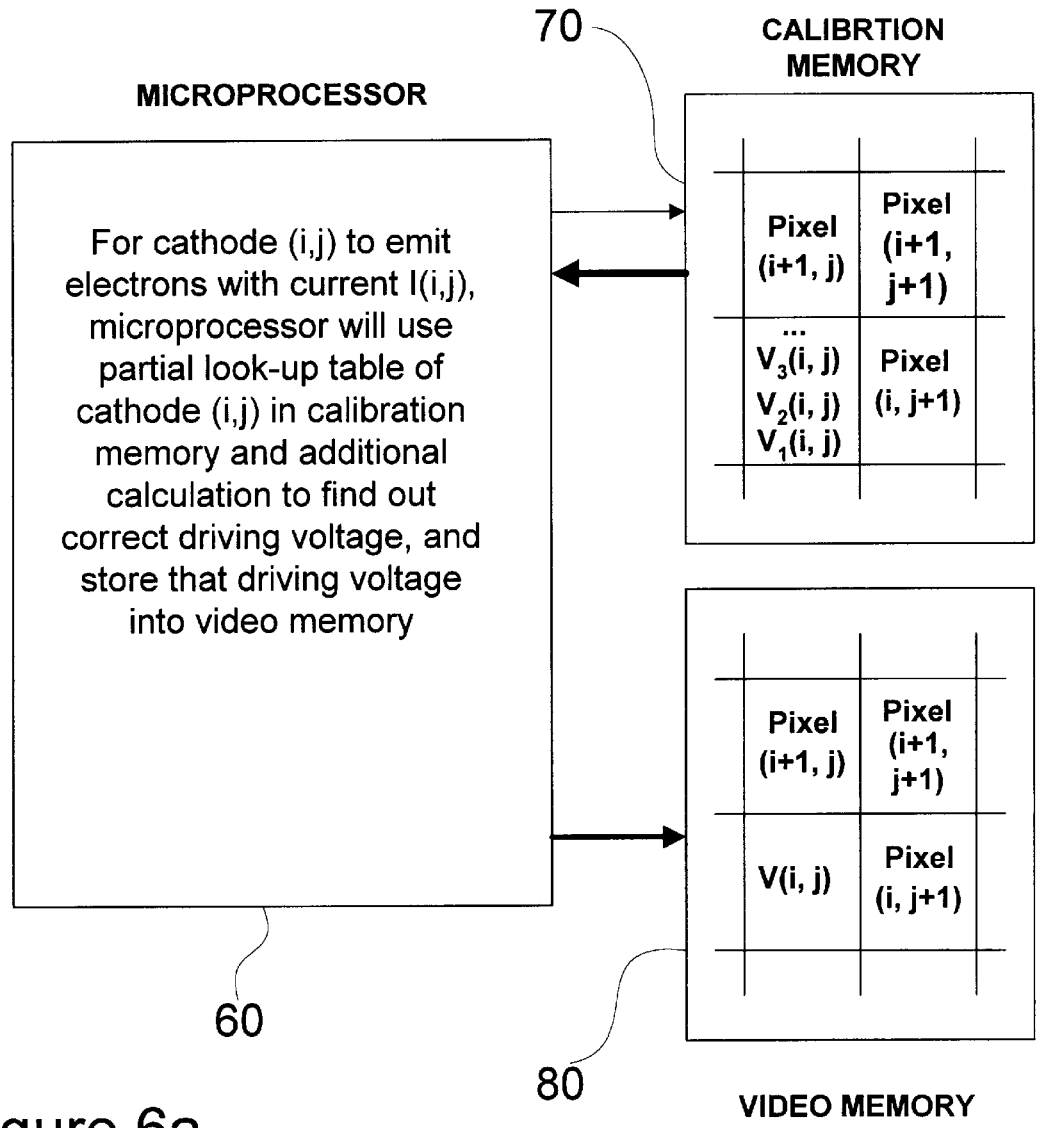
FIG. 6*a* shows that a microprocessor use the partial look-up table in the calibration memory in combination with additional calculation to find out the correct driving voltage, and store the correct driving voltage into the video memory.
Figure 6B:
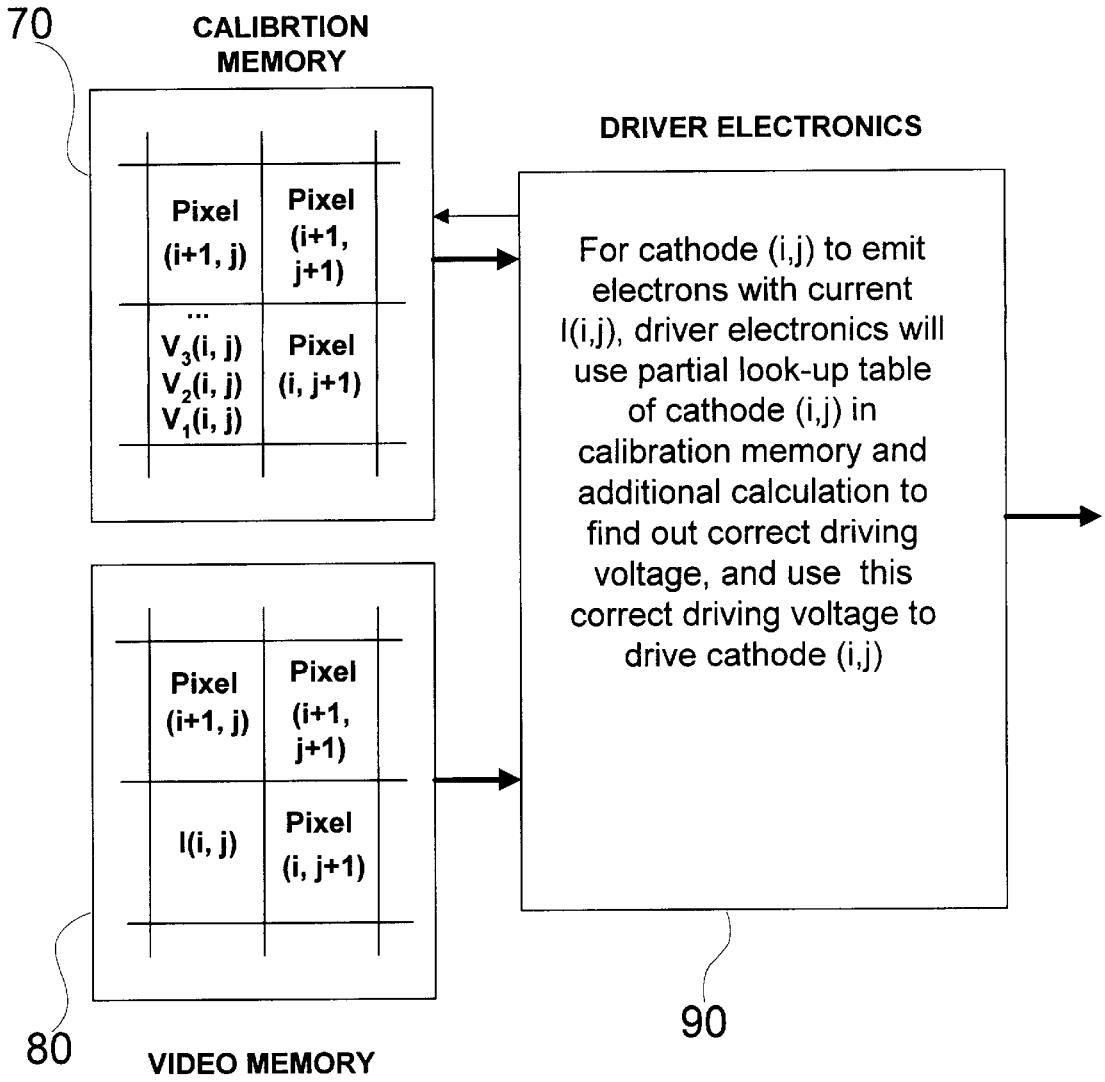
FIG. 6*b* shows that the driver electronics fetch uncompensated light intensity from the video memory and use the partial look-up table in the calibration memory in combination with additional calculation to find out the correct driving voltage.

FIG. 6*a* and 6*b* show in detail the method two mentioned previously. With method two, for every cathode in the display, the correct driving voltages—$V_1(i, j)$, $V_2(i, j)$, $V_3(i, j)$, . . . , and $V_K(i, j)$—for selected number of gray levels with corresponding desired emission current—$I_1$, $I_2$, $I_3$ . . . , and $I_K$—are calculated and used as calibration parameters. These calibration parameters are stored as partial look-up tables in a calibration memory 70 for future use. The driver electronics will use the partial look-up tables in combination with some additional calculation in real time to find the correct driving voltages. Where the number of gray levels K selected are smaller than the number of total gray levels. As for the issue on how to chose $I_1$, $I_2$, $I_3$ . . . , and $I_K$, it may be chosen based on the non-linearity of the emission curve or just chosen for convenience, such as for a four point calibration, one simply may chose $I_1=(1/4)I_0$, $I_2(2/4)I_0$, $I_3=(3/4)I_0$, and $I_4=I_0$, where $I_0$ is the emission current corresponding to the maximum light intensity.

After the calibration parameters are calculated and stored as partial look-up tables in calibration memory 70, the next step is to use the partial look-up tables to calculate the correct driver voltages to provide nearly perfect display uniformity for a FED.

With a conventional display, if a computer want a pixel to display certain intensity, it will write the intensity word (which is a byte for 8 bit gray level) of the pixel to a location in a video memory, and the driver electronics will use the intensity words in the video memory to drive the display. With present newly invented display, however, if a computer want a pixel to display certain desired intensity, it will first fetch the related calibration parameters from the corresponding partial look-up table from calibration memory 70, as shown in FIG. 6*a*, then, use these calibration parameters along with the intensity word to calculate the correct driving voltage that can achieve the desired intensity for that pixel, write this correct driving voltage to video memory 80, and the driver electronics will use the correct driving voltages in video memory 80 to drive the field emission display. Alternatively, as shown in FIG. 6*b*, the computer can still write the uncompensated intensity word to video memory 80, but, the driver electronics itself will use the partial look-up table in calibration memory 70 in combination with some calculations to find out the correct driving voltage for any gray level of any cathode, and use this correct driving voltage to drive the field emission display directly. In both of the above two alternatives, some calculations are required to obtain the correct driving voltage; these calculation can be performed with a microprocessor 60, which can be the main microprocessor or preferably a dedicated display processor. In the following, several algorithms for performing these calculations are described, and for linear approximation, a specific design of display processor 60 is described.

Figure 7A:
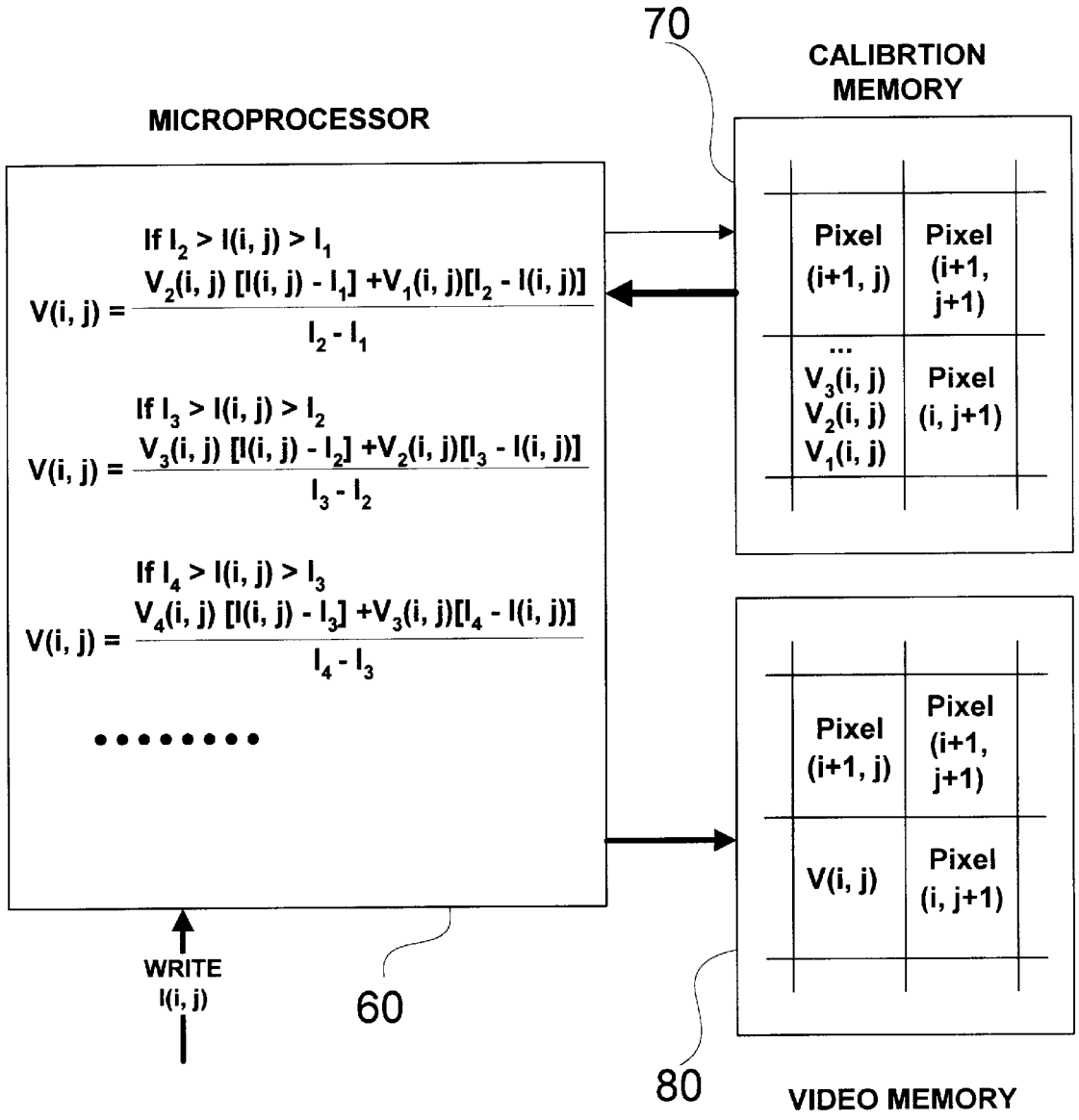
FIG. 7*a* shows that a microprocessor use the partial look-up table in the calibration memory in combination with linear approximation to calculate the correct driving voltage, and store the correct driving voltage into the video memory.
Figure 7B:
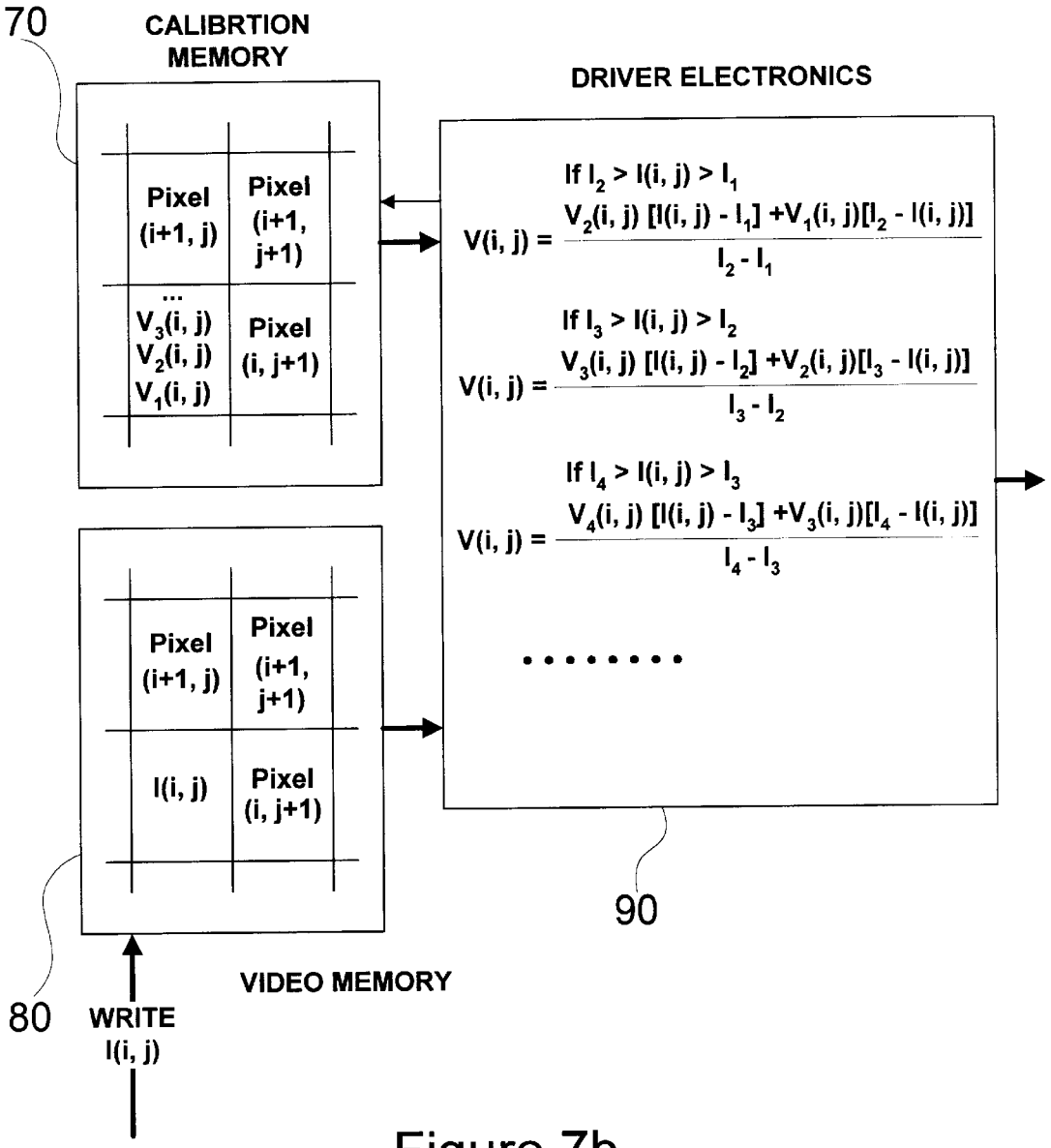
FIG. 7*b* shows that the driver electronics fetch uncompensated light intensity from the video memory and use the partial look-up table in the calibration memory in combination with linear approximation to calculate the correct driving voltage.

FIG. 7*a* illustrates a specific implementations of FIG. 6*a* based on linear approximations, and FIG. 7*b* illustrates that of FIG. 6*b*. In FIG. 7*a* or 7*b*, the microprocessor 60 or driver electronics 90 first compare desired intensity I(i, j)—which is the desired emission current in this case—with the set of intensity levels ($I_1$, $I_2$, $I_3$ . . . , and $I_K$) which have pre-calculated driving voltages stored in calibration memory 70, the microprocessor find the two numbers (among $I_1$, $I_2$, $I_3$ . . . , and $I_K$) which are most close to the desired intensity I(i, j));, the microprocessor 60 or driver electronics 90 will then fetch the driving voltages corresponding to these two numbers from calibration memory 70 and use liner approximation to calculate the driving voltage V(i, j) which can achieve the desired intensity I(i, j); finally, the calculated driving voltage V(i, j) is stored in video memory or used by driver electronics to driver the display directly. Take an example of how V(i, j) is calculated, if $I_2<I(i, j)<I_3$, then $$V(i, j) = \frac{V_3(i, j)[I(i, j) - I_2] + V_2(i, j)[I_3 - I(i, j)]}{I_3 - I_2}.$$

Figure 7C:
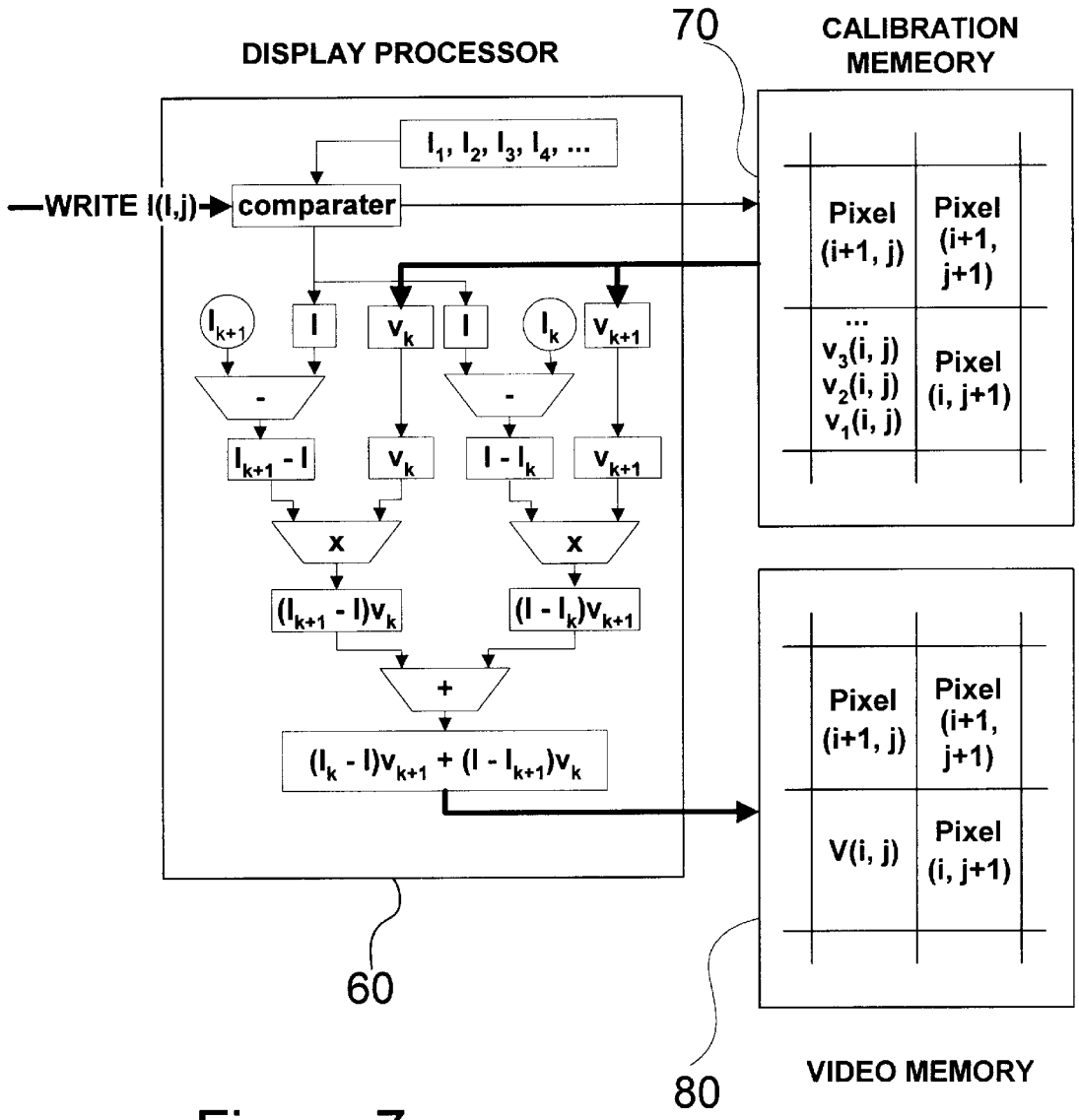
FIG. 7*c* shows a specific implementation of a display processor which uses linear approximation to calculate the correct driving voltage.

In fact to simplify the above calculation and speed up the calculation in real time, one can chose $\Delta I=I_2-I_1=I_3-I_2= \ldots =I_K-I_{K-1}$, and rather than store $V_k(i, j)$ (with k=1, 2, . . . K) in the calibration memory, one can store $v_k(i, j)=V_k(i, j)/\Delta I$ (with k=1, 2, . . . K) in calibration memory 70. The microprocessor 60 or driver electronics 90 then use $v_k(i, j)$ to calculate the desired voltage $V(i, j)=v_{k+1}(i, j)[I(i, j)-I_k]+v_{k+1}(i, j)[I_{k+1}-I(i, j)]$, where $I_k<I(i, j)<I_{k+1}$. The microprocessor used to perform the above calculations can be the main microprocessor or a dedicated display processor. FIG. 7*c* illustrates a specific design of display processor 60 based on above linear approximation by using hardware gate elements.

To minimize the calibration memory requirement one can store a normalized variation of $v_k(i, j)$ . The normalized variation $\alpha_k(i, j)$ is defined by $v_k(i, j)=\overline{v}_k[1+S\alpha_k(i, j)]$, where S is a scaling factor which depend on the variations of all the $v_k(i, j)$, and $\overline{v}_k$ is the average of $v_k(i, j)$ over all cathodes $$\overline{v}_k = \frac{1}{N * M} \sum_{i=1,j=1}^{N,M} v_k(i, j).$$

The average $\overline{v}_1$, $\overline{v}_2$, $\overline{v}_3$ . . . and $\overline{v}_K$, and the scaling factor S are also stored in a memory, and these numbers can be loaded into the microprocessor to perform the calculation. The design of a dedicated display processor by using the normalized variation $\alpha_k(i, j)$ is straight forward for the people skilled in the art, and will not be discussed further here.

To demonstrate the feasibility of the current invention, we now estimate the amount of the calibration memory that is required and the processing power of the display processor that is required. Assume the display have 1600×1200 pixels and in each pixel one cathode is used to create three colors (the color is created by changing the anode voltage on the color segments), and assume four calibration points are stored for each emission curve, if one byte is used to store each normalized variation $\alpha_k(i, j)$, then, the total memory required is 1600×1200×4=7,680,000 byte. If the display is refreshed 60 times in a second, then, 1600×1200×60=115,200,000 calculations need to be performed in a second. The sample architecture of the display processor in FIG. 7*c* indicates that simple pipe line design can be used, and with the pipeline design one calculation can be performed with every clock cycle. Therefore, a display processor running at 115 MHz is powerful enough for the current invention. With more advanced design, in which more than one instructions are performed for each clock cycle, a microprocessor running at a clock rate with a fraction of 115 MHz is powerfil enough for the present application.

In FIG. 7*a* or 7*b*, the microprocessor 60 or the driver electronics 90 first compare desired intensity I(i, j)—which is the desired emission current in this case—with the set of intensity levels ($I_1$, $I_2$, $I_3$ . . . , and $I_K$) which have pre-calculated driving voltage stored in calibration memory 70, the microprocessor 60 or the driver electronics 90 find the two numbers (among $I_1$, $I_2$, $I_3$ . . . , and $I_K$) which are most close to the desired intensity I(i, j) ); the microprocessor 60 or the driver electronics 90 will then fetch the driving voltages corresponding to these two numbers from calibration memory 70 and use liner approximation to calculate the driving voltage V(i, j) which can achieve the desired intensity I(i, j). In fact, one can also use polynomial approximation to calculate the driving voltage V(i, j) which can achieve the desired intensity I(i, j). For example, $$V(i, j) = \frac{(I_2 - I)(I_3 - I)\cdots(I_K - I)}{(I_2 - I_1)(I_3 - I_1)\cdots(I_K - I_1)} V_1(i, j) + \frac{(I_1 - I)(I_3 - I)\cdots(I_K - I)}{(I_1 - I_2)(I_3 - I_2)\cdots(I_K - I_2)} V_2(i, j) + \cdots$$

One can even use more complicated algorithm, such as, least square fit to calculate the driving voltage V(i, j) which can achieve the desired intensity I(i, j). Of course, the more complicated the algorithm, the more it is required for the processing power of the microprocessor 60 or the driver electronics 90. One need to make a compromise between the processing power and the amount of calibration memory required. With enough calibration memory, simple linear approximation algorithm can already provide the satisfactory results.

Figure 7D:
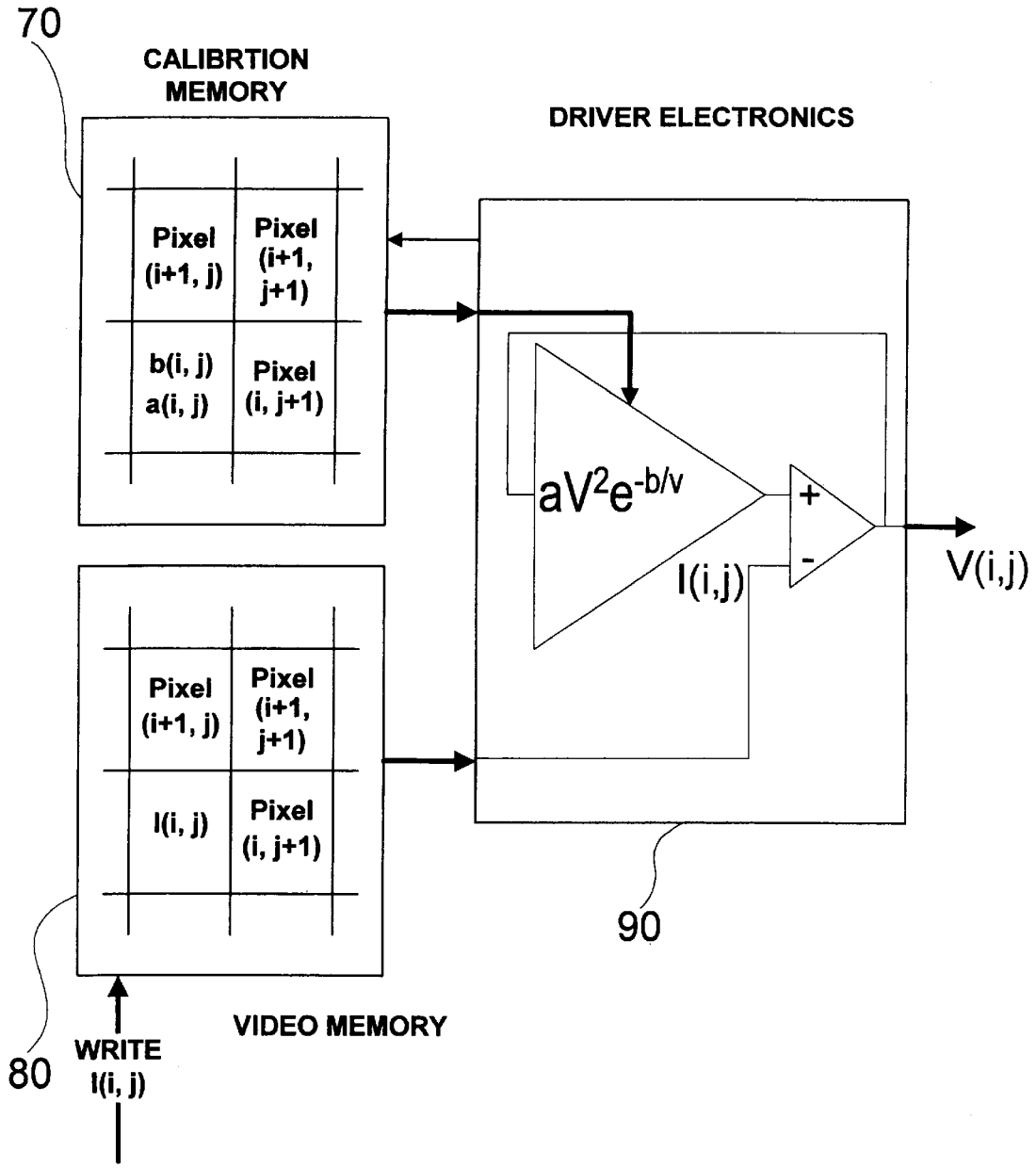
FIG. 7*d* shows that the driver electronics fetch calibration parameters a(i,j) and b(i,j) from the calibration memory and use Fowler-Nordheim model to calculate the correct driving voltage.

If Fowler-Nordheim model is used, $I=aV^2 \exp(-b/V)$, and suppose a and b are used as calibration parameters, the correct diving voltage V(i, j) which can achieve the desired intensity I(i, j) then can be calculated based on equation $I(i, j)-a(i, j)V^2(i, j)e^{-b(i,j)/V(i,j)}=0$, where a(i,j) and b(i,j) are fetched from calibration memory 70. FIG. 7*d* shows an example that the calculation is performed with a feedback electronics. In FIG. 7*d*, the desired intensity I(i, j) is stored in video memory 80, a driver electronics 90 calculate the correct driving voltage by fetching I(i, j) from video memory 80 and calibration parameters—a(i,j) and b(i,j)—from calibration memory 70, then, driver electronics 90 use the correct driving voltage to drive the display.

Figure 8A:
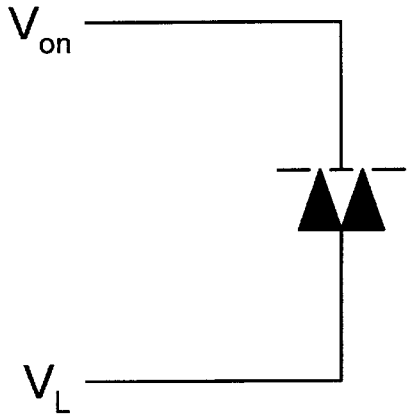
FIG. 8*a* shows that a cathode, presumably in a row of a cathode matrix, is selected by one voltage source and the emission current is determined by another driving voltage source.
Figure 8B:
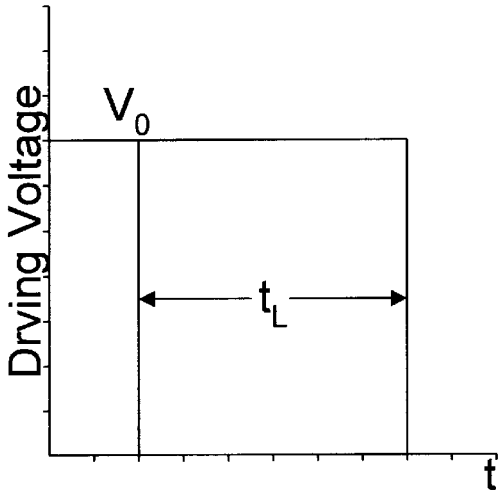
FIG. 8*b* shows that the driving voltage source is turned on for a time period that is determined by the desired luminosity.
Figure 8C:
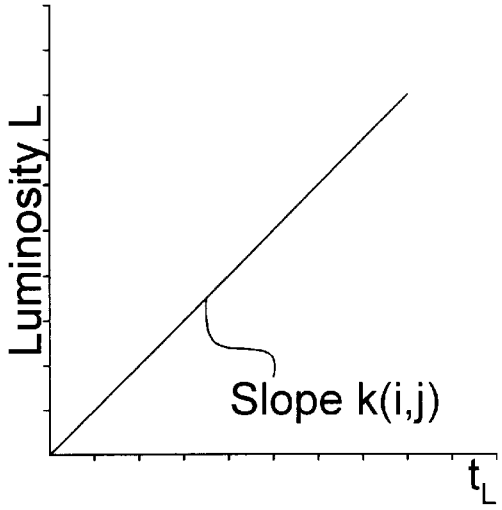
Figure 9A:
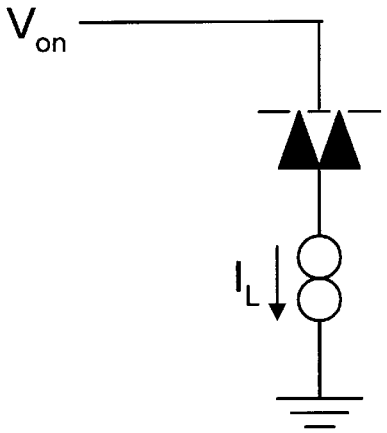
FIG. 9*a* shows that a cathode, presumably in a row of a cathode matrix, is selected by one voltage source and the emission current is determined by another driving current source.
Figure 9B:
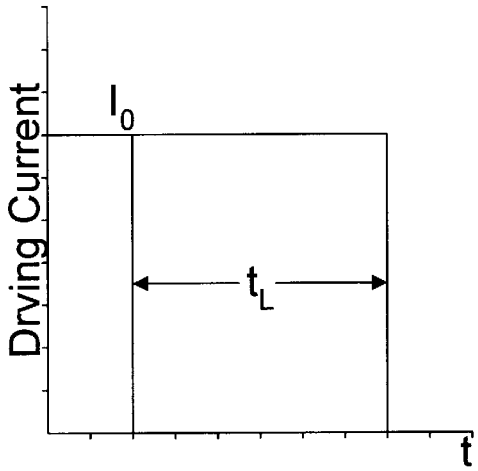
FIG. 9*b* shows that the driving current source is turned on for a time period that is determined by the desired luminosity.
Figure 9C:
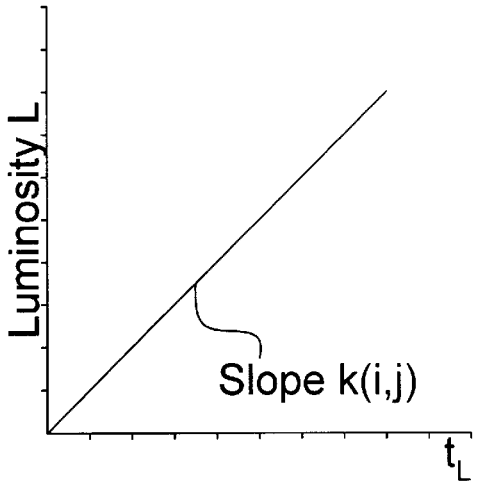

In the above, we show that even the inferior voltage-driving method can be improved with present disclosed method to provide nearly perfect display uniformity. The drawback of the voltage driving method is now turn to be that larger amount of calibration memory have to be used, due to that fact that several calibration parameters have to be stored. Some of the other driving methods, however, can be improved to provide the nearly perfect uniformity by storing only one calibration parameter. In all these kinds of methods, the gray level is roughly proportional to the driving parameter. One example is shown in FIG. 8*a*, 8*b* and 8*c*, which is called voltage-time method for facilitating discussion. Another example is shown in FIG. 9*a*, 9*b* and 9*c*, which we is called current-time method. And the third example is shown in FIG. 10*a*, 10*b* and 10*c*, which is called current-driving method.

In the voltage-time method, as shown in FIG. 8*a*–8*c*, a voltage $V_{on}$ is used to select one row of cold cathodes in a matrix to emit electrons, and for each cold cathode in that selected row, another voltage source $V_L$ is applied to make the cathode to emit electrons. Of course, the number of voltage sources $V_L$ is equal to the number of cold cathodes in each row. The amplitude of voltage $V_L$, when applied to a cathode, is always the same constant voltage $V_0$, but the time interval $t_L$ during which $V_L$ is applied will determine the luminosity L perceived by an user. And in fact, luminosity L is linearly proportional to $t_L$, as shown in FIG. 8*c*. Because the manufacture variations, different cathode in the cathodes matrix may have different slope k in the L verses $t_L$ curve. And the emission characteristics of a cathode can be determined by a single parameter k, which can be measured by a single measurement.

In the current-time method, as shown in FIG. 9*a*–9*c*, a voltage $V_{on}$ is used to select one row of cold cathodes in a matrix to emit electrons, and for each cold cathode in that selected row, another current source $I_L$ is applied to make the cathode to emit electrons. Of course, the number of current sources $I_L$ is equal to the number of cold cathodes in each row. The amplitude of current $I_L$, when applied to a cathode, is always the same constant current $I_0$, but the time interval $t_L$ during which $I_L$ is applied will determine the luminosity L perceived by an user. And in fact, luminosity L is linearly proportional to $t_L$, as shown in FIG. 9*c*. Because the manufacture variations, different cathode in the cathodes matrix may have different slope k in the L verses $t_L$ curve. And the emission characteristics of a cathode can be determined by a single parameter k, which can be measured by a single measurement.

Figure 10A:
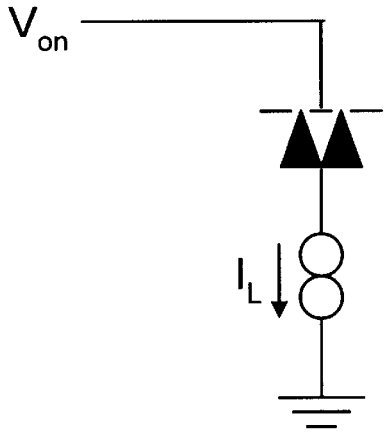
FIG. 10*a* shows that a cathode, presumably in a row of a cathode matrix, is selected by one voltage source and the emission current is determined by another driving current source.
Figure 10B:
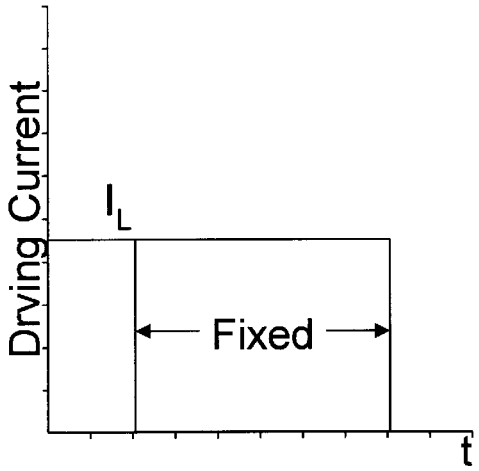
FIG. 10*b* shows that the driving current source is turned on for a fixed time period, and the desired luminosity is determined by the current level in the driving current sources.
Figure 10C:
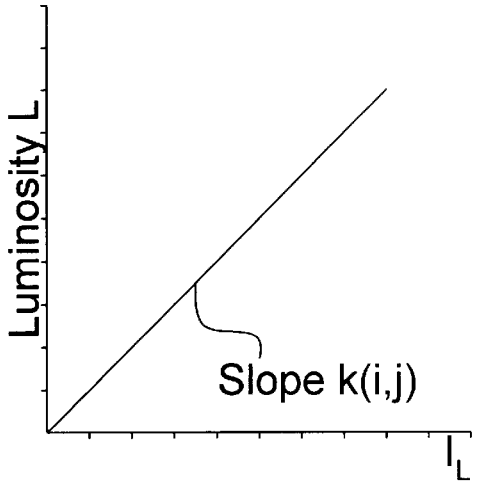
FIG. 10*c* shows that the luminosity perceived by an user is linearly proportional to the current level in the driving current sources.

In the current-driving method, as shown in FIGS. 10*a*–10*c*, a voltage $V_{on}$ is used to select one row of cold cathodes in a matrix to emit electrons, and for each cold cathode in that selected row, another current source $I_L$ is applied to make the cathode to emit electrons. Of course, the number of current sources $I_L$ is equal to the number of cold cathodes in each row. The time interval $t_L$ during which $I_L$ is applied is always the same. The amplitude of the current $I_L$ applied to a cathode will determine the luminosity L perceived by an user. And in fact, luminosity L is linearly proportional to $I_L$, as shown in FIG. 10*c*. Because the manufacture variations, different cathode in the cathode matrix may have different slope k in the L verses $I_L$ curve. And the emission characteristics of a cathode can be determined by a single parameter k, which can be measured by a single measurement.

Figure 11A:
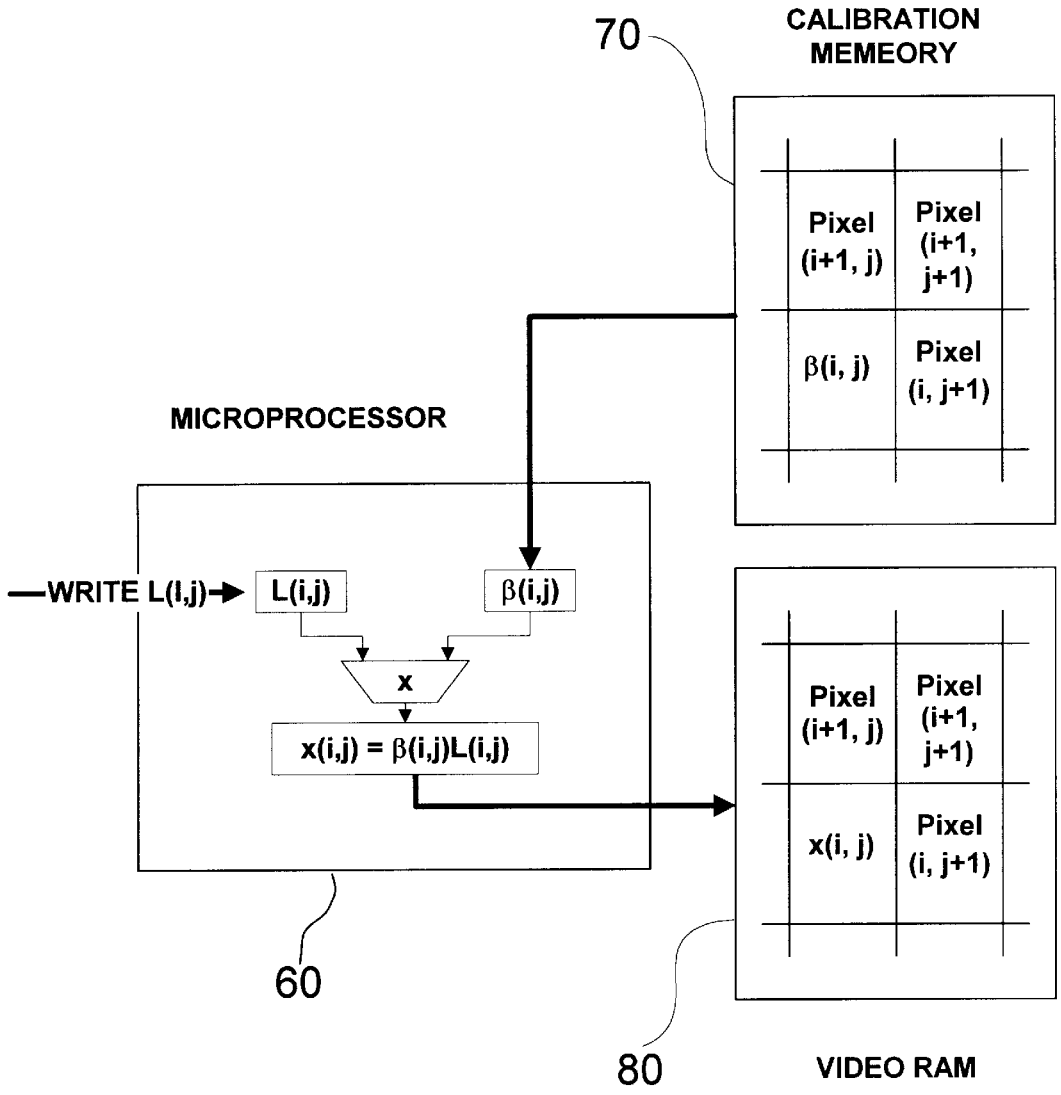
FIG. 11*a* shows that, for linear emission characteristics, a microprocessor uses the calibration parameter stored in the calibration memory to calculate the correct driving parameters, and store the correct driving parameters into the video memory. In this case, the calibration parameter of a cathode is simply the inverse of the slope of the line representing the luminosity versus the driving-parameter.
Figure 11B:
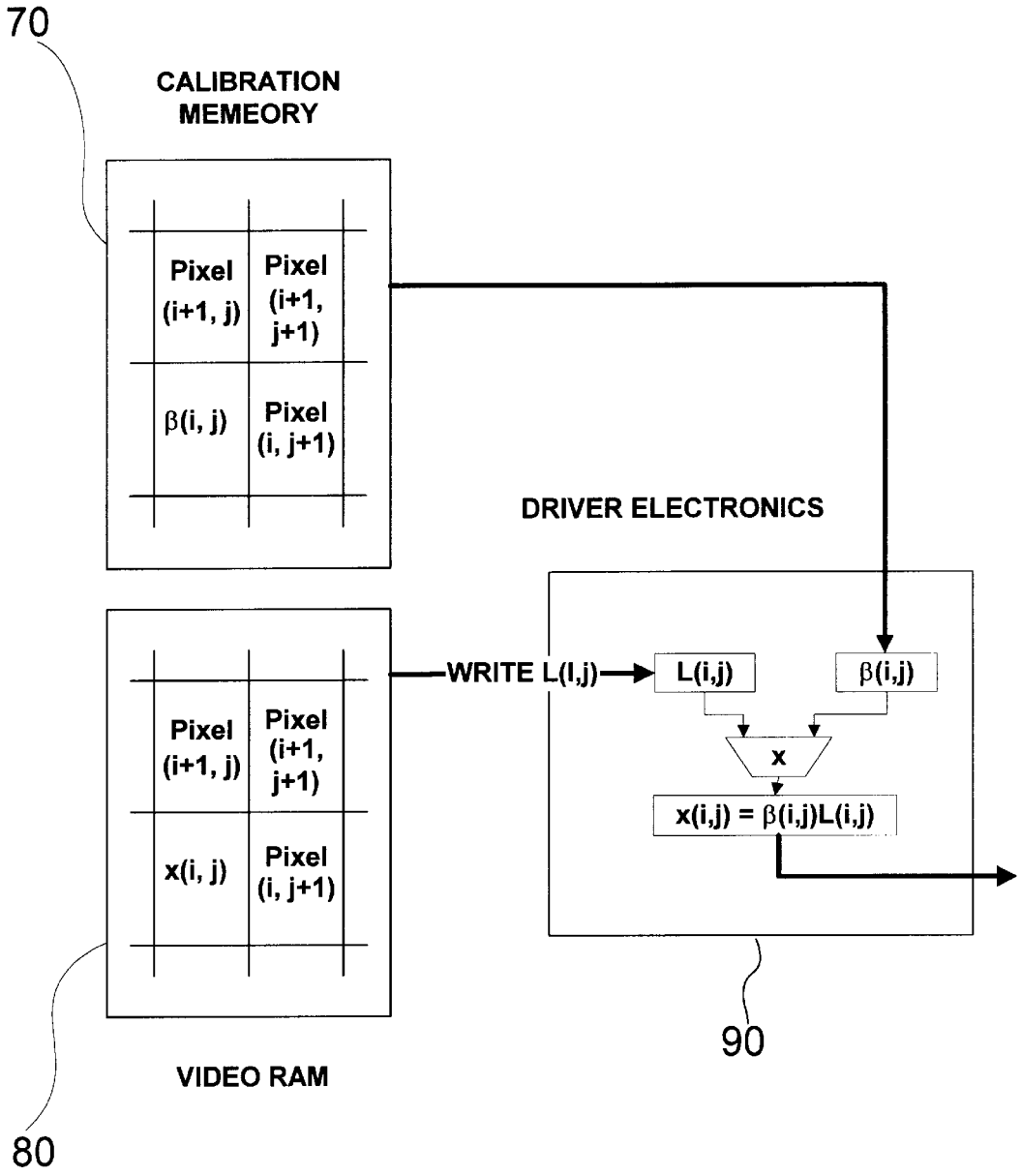
FIG. 11*b* shows that, for linear emission characteristics, the driver electronics uses the calibration parameter stored in the calibration memory to calculate the correct driving parameters. In this case, the calibration parameter of a cathode is simply the inverse of the slope of the line representing the luminosity versus the driving-parameter.

Once the emission characteristics of each cathode in the cathode matrix is measured, and the calibration parameter (which is related to the slope of the emission characteristics) of each cathode is stored in a calibration memory, nearly perfect display uniformity can be obtained by a simple calculation, which is just a single step of multiplication. We may use L=kx to generally represent L versus $t_L$ or L versus $I_L$, where x is the driving parameter ($t_L$ or $I_L$). The driving parameter x at cathode (i, j) can be determined by the desired luminosity L(i, j) and the slope k(i, j). If $\beta(i, j)=1/k(i, j)$ is stored in the calibration memory as shown in FIG. 11*a* or FIG. 11*b*, the driving parameter x(i, j) can be obtained from a simple multiplication, $x(i, j)=\beta(i, j)L(i, j)$. In FIG. 11*a*, a microprocessor 60 will first calculate the correct driving parameter x(i, j) which provides the desired luminosity L(i, j), then store the correct driving parameter x(i, j) in video memory 80, and the driver electronics will use the correct driving parameter x(i, j) in video memory 80 to drive the display. In FIG. 11*b*, the uncompensated luminosity L(i, j) is stored in video memory 80, the driver electronics 90 will calculate the correct driving parameter x(i, j) which provides the desired luminosity L(i, j) by fetching L(i, j) from video memory 80 and β(i, j) from calibration memory 70, and driver electronics 90 will use the correct driving parameter x(i, j) to drive the display directly. Again, to minimize the calibration memory requirement, instead of storing β(i, j) in the calibration memory, one can store γ(i, j), defined by $\beta(i, j)=\beta_0[1+S\gamma(i, j)]$, where $\beta_0$ is the average of β(i, j) over all cathodes and S is a scaling factor. And microprocessor 60 or driver electronics 90 need to perform a slightly more complicated calculation $x(i, j)=\beta_0[1+S\gamma(i, j)]L(i, j)$. Microprocessor 60 can be the main microprocessor or a dedicated microprocessor.

The embodiment shown in FIG. 11*a* when applied to the current-driving method is the most preferred embodiment among all the embodiments and methods disclosed in the present disclosure.

The emission characteristics of the above discussed three methods—voltage-time method, current-time method and current-driving—is linear only in the ideal situation. Other factors, such as the capacitance of the cathode, can make the emission characteristics deviate from the ideal linear relationship.

Taking current-driving method as an example, because the capacitor of a cathode has to be charged up before electron emission occurs and the rate of charging up the capacitor depends on the driving current, thus, the emission characteristics will not be perfectly linear. And because the rate of charging up the capacitor of a cathode also depend on the value of the capacitor, which varies from cathode to cathode due to the inevitable manufacture variations, thus, the emission characteristics of a cathode will not only be non-liner but also varies from one cathode to another cathode. Another reason that the emission characteristics of a cathode varies from one cathode to another cathode is that different cathode have different emission coefficient (or the ratio of the emission current to the driving current). There has been some attempt to solve this problem associated with current-driving method, such as the method described in U.S. Pat. No. 5,514,937 and 5,578,906. These methods have only provided limited success. Based on the teaching in the present disclosure, it is clear that the display non-uniformity problem can be easily solved by present disclosed method. Repeating a summary of the present disclosed method: first, the emission characteristics of every cathode is measured; then, correct driving parameters of every cathode are stored as a complete look-up table in a calibration memory or the calibration parameters of every cathode are stored as a partial look-up table in a calibration memory; finally, the correct driving parameters of every cathode are obtained from the complete look-up table without additional calculation, or obtained from the partial look-up table with additional calculation, and correct driving parameters are used to drive the display. When the emission characteristics of a cathode in current-driving method is no longer linear, more than one point on the emission characteristics curve have to be measured.

We now turn to the discussion on how to measure the emission characteristics of a cathode. In order to measure the emission characteristics of all cathodes in the cathode matrices of a thin CRT display, one row of cathodes is selected at one time. When that particular row is selected, the emission characteristics of one individual cathode in that row is measured one by one, by measuring one cathode at a time and by setting all the rest of the cathodes in that row to non-emitting state. When measuring the emission characteristics of one cathode, one point on the emission characteristics curve is measured if the curve is linear, and several points on the emission characteristics curve are measured if the curve is non-liner. In the case that the emission characteristics curve is non-liner, the number of points needed to be measured depend on the non-linearity of the curve, the variations of the curve among different cathodes, and the number of gray levels needed to be achieved with the thin CRT display.

Figure 12:
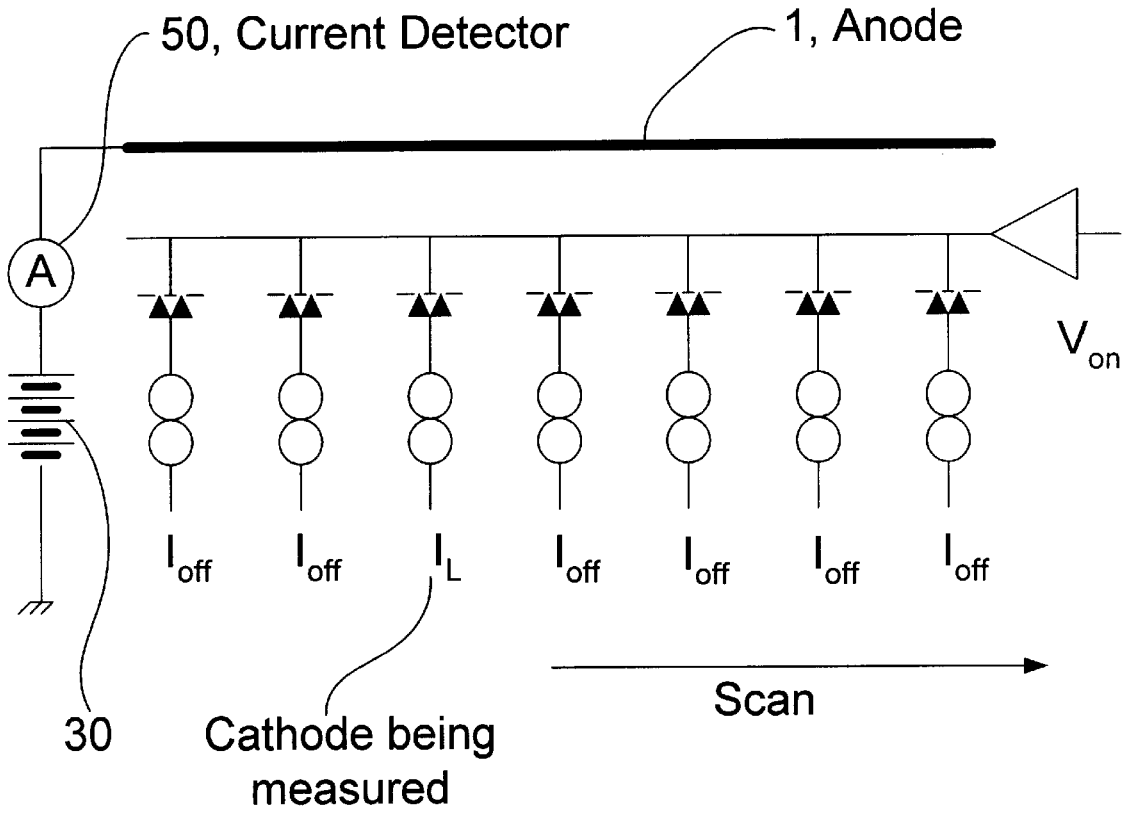
FIG. 12 shows that emission characteristics of every cathode is measured by a current detector and by turning on the driving current for only one cathode at a time.

In the previous discussion of voltage-driving method, the emission characteristics of a cathode is measured by measuring the curve of emission current versus driving voltage. Similarly, with current-driving method, the emission characteristics of a cathode can be measured by measuring the curve of emission current versus driving current, as shown in FIG. 12. However, with voltage-time and current-time methods, one needs to measure the emission current integrated over the time period during which the driving voltage or current is turned on, and the emission current integrated over that time period is actually the total charge that is emitted onto the anode. Because the total charge that is emitted onto the anode by a particular cathode is directly proportional the luminosity perceived by an user, therefore, the curve of the total charge versus the driving parameter (which can be voltage, current or time) is a faithful representation of the curve of the luminosity versus the driving parameter. Thus, with voltage-time and current-time methods, the emission characteristics of a cathode is measured by measuring the curve of the total emitted charge versus the time period during which the driving voltage or current is turned on. And in fact, with voltage-driving method, the emission characteristics of a cathode can also be measured by measuring the curve of the total emitted charge versus the driving voltage, and with current-driving method, the emission characteristics of a cathode can be measured by measuring the curve of the total emitted charge versus the driving current as well.

To measure the total charge that is emitted onto the anode by a cathode, one can measure the emission current and integrate the emission current with an integrator over the time period that is allocated for that cathode to emit. Generally, that time period can be a constant to simplify the design. With voltage-driving and current-driving methods, that time period is already a constant. With voltage-time and current-time methods, the integration time can be the maximum time period that a cathode can be turned on. For gray level less than the maximum luminosity, the actual time period that a cathode is turned on is of course smaller than the maximum time period that a cathode can be turned on, and the integration over the maximum time period is the same as the integration over the actual time period. After measuring the total charge emitted (or the emission current integrated over time), one store the measured value of the total charge into a memory for further calculation. And again, the curve of the total charge versus the driving parameter is a faithful representation of the emission characteristics of a cathode.

Figure 13:
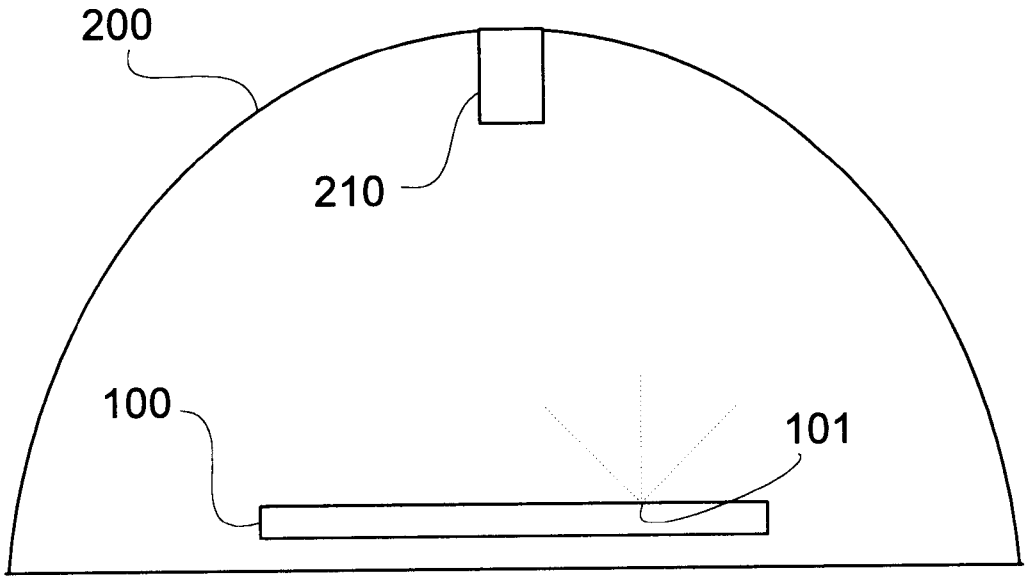
FIG. 13 shows that emission characteristics of every cathode is measured by a photo detector in a dark chamber by turning on only one cathode at a time.

Another way of measuring of the emission characteristics of every cathode in a display is to perform all the measurement in a dark chamber. As shown in FIG. 13, for a particular thin CRT 100, to obtain a light-intensity versus driving-parameter table for a pixel 101, be it complete or partial, one can put thin CRT 100 in a dark chamber 200 and use a photo detector 210 to measure the light intensities with a set of driving parameters for that pixel 101 while all the rest of pixels are completely turned off. And, one need to repeat the same procedure one pixel at a time, until the light-intensity versus driving-parameter tables of all pixels in the thin CRT are measured. These steps of measuring display characteristics of each pixel in a thin CRT can be performed in the factory before the thin CRT is shipped. The measurement may need to be performed with different temperatures in the case that the emission characteristics of each pixel is temperature dependent. Then, these measured emission characteristics are used to obtain the complete or partial look-up tables. Finally, the complete or partial look-up tables are stored in a permanent memory for future use.

In present disclosed method, the process of compensating non-uniformity of a thin CRT display consists of the stage of measuring the emission characteristics of every cathode, the stage of determining the calibration parameters from the measured emission characteristics, and the stage of using the calibration parameters of every cathode to calculate the correct driving parameters which will give desired luminosity levels.

For the stage of measuring the emission characteristics of every cathodes, one can measure those emission characteristics only once, calculate the correct driving parameters and store them as complete look-up tables in a permanent memory, or calculate the calibration parameters and store them as partial look-up tables in a permanent memory. Later on, one can always use those stored complete or partial look-up tables to obtain the correct driving parameters, provided the emission characteristics of those cathodes do not change over time. If the emission characteristics of those cathodes changes or degrade over time, one has to measure the emission characteristics periodically, say, once every month, and how often that need to be re-measured depend on the rate of changes of those emission characteristics. If the users don't mind to wait for a while (say a few seconds to a few minutes, depend on the number of points that need to be measured), then, one don't have to use permanent storage, since one can simply measure those characteristics at the time when the display power is turned on and store those numbers in a RAM.

For the stage of using the calibration parameters of every cathode to calculate the correct driving parameters, one can use specially designed display processor to perform the calculation or use a software programmed general purpose microprocessor, which can even be the main CPU.

In the above presentation of the present invention, we have used field emission display as an example. In fact, as pointed out in the introduction, present invention is applicable to any kinds of thin CRT displays based on matrix of cold cathodes, in any kind of driving arrangement, provided that any one of the individual cold cathode can be addressed independently. One example is Canon's surface conducting electron display (SED). There are several designs and driving schemes of the surface conducting electron display, and present invention of improving display uniformity is applicable to all those designs and driving schemes. In particular, present invention is applicable to all the disclosed designs and driving schemes disclosed in U.S. Pat. No. 5,627,436 and the references cited therein.

For any kinds of thin CRT displays based on matrix of cold cathodes of any kinds, in any kind of driving arrangement. If any one of the individual cold cathode in the matrix can be addressed independently, then, the emission characteristics of any cold cathode can be measured independently. Once the measured emission characteristics of all cold cathodes are measured, the correct driving parameters of all cathodes can be calculated and stored as complete look-up tables, or the calibration parameters of all cathodes can be calculated and stored as partial look-up tables in a calibration memory. A microprocessor can use the stored complete or partial look-up tables to obtain nearly perfect display uniformity based on the algorithm and methods disclosed in the present invention. The emission characteristics of a cathode in the cathode matrix can be measured with a current detector connected to the anode. The emission characteristics of a cathode can be measured by using the current detector to measure the total emitted charges (or simply emission current in some cases), for one or several values of driving parameters—such as voltage, current or time. The emission characteristics of a cathode in the cathode matrix can also be measured in a dark chamber.

In the above, present invention has been applied to filed emission displays and very briefly to Canon's surface conducting emission display, the more detailed discussion on how to use present disclosed method in all other kinds of thin CRT displays will not be repeated here, and it is apparent for the people skilled in the art to apply present disclosed method to any kinds thin CRT displays with any kind of cold cathodes based on any kind of driving schemes. The kind of cold cathodes mentioned above include, but not limited to, Spindt field emission cathodes, Surface Conducting Electron (SCE) cathodes, MIS cathodes, Silicon avalanche cathodes, diamond cathodes, MIM cathodes, pn junction cathodes and Schottky junction cathodes. The kind of driving schemes mentioned above include, but not limited to, any amplitude modulation schemes with examples of voltage-driving method or current-diving method, any pulse width modulation schemes with examples of voltage-time or current-time method, and any combination schemes of amplitude modulation and pulse width modulation with which the luminosity of a pixel is changed by changing both the amplitude and the pulse width of the driving parameter such as voltage or current.

The forgoing description of selected embodiments and applications has been presented for purpose of illustration. It is not intended to be exhaustive or to limit the invention to the precise form described, and obviously many modifications and variations are possible in the light of the above teaching. The embodiments and applications described above was chosen in order to explain most clearly the principles of the invention and its practical application thereby to enable others in the art to utilize most effectively the invention in various embodiments and with various modifications as are suited to the particular use contemplated. Accordingly, the scope of the invention should be determined not by the embodiments illustrated, but by the appended claims and their legal equivalents.

I claim:

1. A method for creating a video data signal compensated for the non-uniformity of a thin CRT display having a matrix of cathodes, comprising the steps of:

measuring the emission curve of each cathode in the matrix of cathodes by measuring at least one data point on the emission curve;

deriving a set of fitting parameters comprising at least one member for the emission curve of each cathode in the matrix of cathodes from the measured data points of the corresponding cathode;

storing the set of fitting parameters for the emission curve of each cathode in the matrix of cathodes into a calibration memory;

obtaining the compensated video word for each cathode in the matrix of cathodes by using the set of fitting parameters for the emission curve of the corresponding cathode from the calibration memory; and storing into a video memory having a matrix of memory-cells the compensated video word for each cathode in the matrix of cathodes.

2. A method of claim 1 wherein said step of deriving further comprises the step of storing the measured data points of the emission curve of each cathode first into a nonvolatile memory; and the step of loading the measured data points of the emission curve of each cathode into a RAM from the nonvolatile memory.

3. A method of claim 1 wherein the calibration memory is a nonvolatile memory.

4. A method of claim 1 wherein the calibration memory is a volatile memory and said step of storing the set of fitting parameters further comprises the step of storing the set of fitting parameters for the emission curve of each cathode first into a nonvolatile memory; and the step of loading the set of fitting parameters for the emission curve of each cathode into the calibration memory from the nonvolatile memory.

5. A method of claim 1 wherein said step of deriving further comprises the step of determining the correct driving parameters for all gray levels of the cathode by using the measured data points on the emission curve of the corresponding cathode as the row data;

said step of storing further comprises the step of storing the correct driving parameters for all gray levels of the cathode into the calibration memory; and said step of obtaining further comprises the step of fetching the correct driving parameter for the corresponding cathode from the calibration memory.

6. A method of claim 1 wherein said step of deriving further comprises the step of determining the correct driving parameters for selected gray levels of the cathode by using the measured data points on emission curve of the corresponding cathode as the row data;

said step of storing further comprises the step of storing the correct driving parameters for selected gray levels of the cathode into the calibration memory; and said step of obtaining further comprises the step of calculating the compensated video word by using the correct driving parameters for selected gray levels of the corresponding cathode from the calibration memory as the raw data.

7. A method of claim 1 wherein said step of deriving further comprises the step of determining the set of fitting parameters for the emission curve of the cathode based on a device model by using the measured data points on emission curve of the corresponding cathode as the row data; and said step of obtaining further comprises the step of calculating the compensated video word by using the device model as the algorithm and by using the set of fitting parameters for the emission curve of the corresponding cathode from the calibration memory as the raw data.

8. A method of claim 1 wherein each cathode in the matrix of cathodes is selected from a group consisting of field emission cathode, surface conducting electron cathode, MIS cathode, silicon avalanche cathode, diamond cathode, MIM cathode, pn junction cathode, Schottky junction cathode, and any combination thereof.

9. A video interfacing electronics, for creating a video data signal compensated for the non-uniformity of a thin CRT display having a matrix of cathodes, having a video memory for storing the video pattern, comprising:

a calibration memory having a set of fitting parameters comprising at least one member for the emission curve stored therein for each cathode in the matrix of cathodes;

electronic circuitry for obtaining the compensated video word for each cathode in the matrix of cathodes by using the set of fitting parameters for the emission curve of the corresponding cathode from said calibration memory; and electronic circuitry for storing into the video memory the compensated video word for each cathode in the matrix of cathodes.

10. A video interfacing electronics of claim 9 wherein the calibration memory is a nonvolatile memory.

11. A video interfacing electronics of claim 9 wherein the calibration memory is a volatile memory, further comprising a nonvolatile memory having the set of fitting parameters for the emission curve of each cathode stored thereinto; and electronic circuitry for loading the set of fitting parameters for the emission curve of each cathode into said calibration memory from said nonvolatile memory.

12. A video interfacing electronics of claim 9 wherein the fitting parameter for the emission curve of each cathode is chosen to be the correct driving parameter for a gray level of the corresponding cathode, and said calibration memory having the correct driving parameters for all gray levels of each cathode stored therein as the fitting parameters; and said electronic circuitry for obtaining further comprises electronic circuitry for fetching the correct driving parameters for each cathode from said calibration memory.

13. A video interfacing electronics of claim 9 wherein the fitting parameter for the emission curve of each cathode is chosen to be the correct driving parameter for a gray level of the corresponding cathode, and said calibration memory having the correct driving parameters for selected gray levels of each cathode stored therein as the fitting parameters; and said electronic circuitry for obtaining further comprises electronic circuitry for calculating the compensated video word by using the correct driving parameters for selected gray levels of the corresponding cathode from said calibration memory as the raw data.

14. A video interfacing electronics of claim 9 wherein the fitting parameter for the emission curve of said cathode is chosen to be the fitting parameters based on a device model for the emission curve of said cathode, and said calibration memory having the fitting parameters stored therein; and said electronic circuitry for obtaining further comprises electronic circuitry for calculating the compensated video word by using the device model as the algorithm and by using the fitting parameters from said calibration memory as the raw data.

15. A method for improving the display uniformity of a thin CRT display with a matrix of cathodes, comprising the steps of:

measuring the emission curve of each cathode in the matrix of cathodes by measuring plural data points on the emission curve;

deriving a set of fitting parameters for the emission curve of each cathode in the matrix of cathodes from the measured data points of the corresponding cathode, where the number of fitting parameters in the set of fitting parameters being larger than one but less than the number of gray levels of each pixel;

storing the set of fitting parameters for the emission curve of each cathode in the matrix of cathodes into a calibration memory;

obtaining the correct driving parameter for each cathode in the matrix of cathodes by using the set of fitting parameters for the emission curve of the corresponding cathode from the calibration memory; and driving each cathode in the matrix of cathodes with the correct driving parameter for the corresponding cathode.

16. A method of claim 15 wherein said step of deriving further comprises the step of determining the set of fitting parameters for the emission curve of the cathode based on a device model by using the measured data points on emission curve of the corresponding cathode as the row data; and said step of obtaining further comprises the step of calculating the correct driving parameter by using the device model as the algorithm and by using the set of fitting parameters for the emission curve of the corresponding cathode from the calibration memory as the raw data.

17. A method of claim 15 further comprising the step of storing into a video memory having a matrix of memory-cells the correct driving parameter for each cathode in the matrix of cathodes.

* * * * *